US006752489B2

(12) United States Patent
Ohashi et al.

(10) Patent No.: US 6,752,489 B2
(45) Date of Patent: Jun. 22, 2004

(54) LIQUID EJECTION HEAD AND METHOD OF MANUFACTURING THE LIQUID EJECTION HEAD

(75) Inventors: Tetsuya Ohashi, Chiba (JP); Yutaka Koizumi, Kanagawa (JP); Masami Kasamoto, Kanagawa (JP); Shuji Koyama, Kanagawa (JP); Junichiro Iri, Kanagawa (JP); Daisaku Ide, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 323 days.

(21) Appl. No.: 09/990,369

(22) Filed: Nov. 23, 2001

(65) Prior Publication Data

US 2002/0075357 A1 Jun. 20, 2002

(30) Foreign Application Priority Data

Nov. 30, 2000 (JP) ..... 2000-365434

(51) Int. Cl.[7] ..... B41J 2/05
(52) U.S. Cl. ..... 347/65; 347/92
(58) Field of Search ..... 347/87, 65, 20, 347/92; 29/890.1

(56) References Cited

U.S. PATENT DOCUMENTS 5,278,585 A * 1/1994 Karz et al. ..... 347/65
5,682,190 A 10/1997 Hirosawa et al. ..... 347/94
6,084,616 A * 7/2000 Nakata et al. ..... 347/65
6,120,139 A * 9/2000 Childers et al. ..... 347/92
6,378,205 B1 * 4/2002 Yoshihira et al. ..... 29/890.1
6,557,989 B1 * 5/2003 Hirosawa et al. ..... 347/87

* cited by examiner

*Primary Examiner*—Anh T. N. Vo
(74) *Attorney, Agent, or Firm*—Fitzpatrick, Cella, Harper & Scinto

(57) ABSTRACT

In a liquid ejection head comprising a plurality of opened liquid flow passages arranged side by side and communicating with ejection orifices through which a liquid is ejected, and thermal energy generating elements for generating thermal energy utilized to eject the liquid through the ejection orifices and generating bubbles in the liquid, at least one closed liquid flow passage closed at one end corresponding to the ejection orifice is provided in at least one end side of the plurality of opened liquid flow passages communicating with the ejection orifices. Since the closed liquid flow passage is not communicated with open air, the liquid is relatively hard to flow into the closed liquid flow passage. Accordingly, a bubble having the function of absorbing a liquid vibration caused upon ejection of the liquid is formed to extend from the interior of the closed liquid flow passage rearward. Vibrations of liquid meniscuses at the ejection orifices can be suppressed with the presence of the bubble. A method of manufacturing the liquid ejection head with ease is also provided.

24 Claims, 16 Drawing Sheets

LIQUID EJECTION HEAD AND METHOD OF MANUFACTURING THE LIQUID EJECTION HEAD

BACKGROUND OF THE INVENTION

1. Field of the Invention

The present invention relates to a liquid ejection head for use in a liquid ejection apparatus in which a liquid, such as an ink, is ejected through an ejection orifice to form a liquid droplet for recording an image, and a method of manufacturing the liquid ejection head. The liquid ejection head of the present invention can be applied to not only general ink jet recording apparatuses, but also to other various types of apparatuses, such as copying machines, facsimiles including communication systems, and word processors including recording units, including industrial recording apparatuses combined with various processors.

2. Description of the Related Art

In recording apparatuses such as printers, copying machines and facsimiles, an image made up of dot patterns is recorded on a recording medium in accordance with image information. From a point of recording method, those recording apparatuses can be divided into the ink jet type, the wire dot type, the thermal type, the laser beam type, and so on. Among them, a recording apparatus of the ink jet type includes an ink jet head in which liquid passages are formed. An energy conversion unit for generating ejection energy utilized to eject a liquid, i.e., ink, is provided in each liquid passage in the head, and the ink is introduced to the liquid passage from an ink supply port through a liquid chamber. In the liquid passage, the ejection energy is applied to the ink, whereupon the ink flies in the form of a droplet toward a recording medium. An image is recorded on the recording medium with the ink droplet impinging against the recording medium. Of various types of ink jet heads, one utilizing thermal energy to eject an ink has been widely practiced because of having advantages in that ink ejection orifices, through which an ink droplet for recording is ejected in the form of a flying droplet, can be arrayed at a high density and the head can be easily constructed in compact size as a whole. Further, in recent years, the number of nozzles arrayed in the ink jet head has increased to meet an increasing demand for recording at a higher rate.

In the ink jet head, however, because ink in the liquid phase is handled, the meniscus vibration in an ejection nozzle is noticeably disturbed due to ink vibration and image quality is sometimes deteriorated. Particularly, in an ink jet head having a large number of nozzles arrayed at a high density, because an ink is moved through a relatively large distance per unit time, a greater inertial force is imposed on the ink in a tank system and moves it forward (toward the head side) when the ejection operation is stopped. With such a greater inertial force, a positive pressure is applied to an ink flow passage, thus bringing the meniscus into a protruded condition. If a next recording signal is inputted in that condition, there occurs the so-called splash printing in which small ink droplets are scattered.

FIG. 17 is a chart showing a waveform of pressure vibration in an ink flow passage responsive to ejection pulses applied to perform one predetermined cycle of ejection in an ink jet head, and FIGS. 18A to 18C are sectional views of a nozzle showing respective meniscus states during a period A (before start of the ejection), a period B (during the ejection), and a period C (immediately after stop of the ejection) denoted in FIG. 17. As seen from FIG. 17, the pressure vibration in the flow passage has a large amplitude a immediately after stop of the ejection. A positive pressure, therefore, occurs in the flow passage and disturbs the meniscus vibration in the next cycle of ejection. More specifically, during the period A denoted in FIG. 17, a stable meniscus M is formed as shown in FIG. 18A. When the ejection operation (pulse energization of a heater 353) is performed in that condition during the period B, a satisfactory liquid droplet 350 is ejected as shown in FIG. 18B. When the operation enters the period C immediately after stop of the ejection, the pressure in a liquid flow passage 352 is increased due to the inertia of liquid movement toward an ejection orifice 351, thus giving rise to a positive pressure in the liquid flow passage 352. The meniscus M is thereby formed in a condition protruding from a surface, in which the ejection orifice 351 is formed, as shown in FIG. 18C. In the worst case, the ink is dropped from the ejection orifice 351. Accordingly, if the next cycle of ejection is started in the condition of FIG. 18C, small ink droplets are scattered and an image cannot be formed in a satisfactory way as mentioned above.

To overcome such a problem, it has been proposed to suppress the meniscus vibration through adjustment of the flow resistance by changing the filter diameter or the ink flow passage. However, setting the flow resistance to a larger value raises a problem in that ink refill to an ejection nozzle is not performed in time and a sufficient amount of ink is not ejected, which causes a deficiency of ink density. On the other hand, setting the flow resistance to a smaller value raises another problem in that, although the ink refill can be performed in time, the amplitude of the meniscus vibration cannot be suppressed and the range of optional matters in design is restricted.

SUMMARY OF THE INVENTION

One object of the present invention is to provide a liquid ejection head, which can suppress a deterioration of liquid ejection characteristics caused by a liquid vibration upon ejection of a liquid, and to provide a method of manufacturing the liquid ejection head.

Another object of the present invention is to provide a liquid ejection head comprising a plurality of opened liquid flow passages arranged side by side and communicating with ejection orifices through which a liquid is ejected, thermal energy generating elements for generating thermal energy utilized to eject the liquid through the ejection orifices and generating bubbles in the liquid, and movable members arranged in an opposed relation to the thermal energy generating elements and having free ends displaceable upon generation of the bubbles, the thermal energy generating elements and the movable members being arranged respectively in the plurality of opened liquid flow passages, wherein at least one closed liquid flow passage closed at one end corresponding to the ejection orifice is provided in at least one end side of the plurality of opened liquid flow passages in a direction in which the opened liquid flow passages are arranged.

In the liquid ejection head having the above features, at least one closed liquid flow passage closed at one end corresponding to the ejection orifice is provided in at least one end side of the plurality of opened liquid flow passages communicating with the ejection orifices. Since the closed liquid flow passage is closed at one end corresponding to the ejection orifice and is not communicated with open air, the liquid is relatively hard to flow into the closed liquid flow passage. Accordingly, a bubble is formed to extend from the interior of the closed liquid flow passage rearward, i.e., toward the other end side of the closed liquid flow passage opposite to the side of the ejection orifices communicating with the opened liquid flow passages. The formation of a bubble means that a buffer capable of absorbing a liquid vibration caused upon ejection of the liquid is formed in the liquid ejection head. As a result, vibrations of liquid meniscuses at the ejection orifices can be suppressed.

In the liquid ejection head of the present invention, the closed liquid flow passage may be provided in both end sides of the plurality of opened liquid flow passages. Also, the liquid ejection head of the present invention may include an ejection orifice plate joined to an end surface of a head body comprising an element substrate in which the thermal energy generating elements are formed, and a top plate joined to the element substrate in an opposed relation, the ejection orifice plate having the ejection orifices formed in positions corresponding to the opened liquid flow passages. The top plate may have a reinforcing portion provided corresponding to the closed liquid flow passage and having one flat surface flush with the end surface of the head body. Further, the reinforcing portion may have a size enough to block off communication between the closed liquid flow passage and an outside. In that case, since the reinforcing portion has one flat surface flush with the end surface of the head body at which the head body is joined to the ejection orifice plate, a joining surface of the ejection orifice plate to the head body is increased in amount equal to one flat surface of the reinforcing portion in flush with the end surface of the head body. As a result, the joining strength of the ejection orifice plate can be increased to a more reliable level.

Still another object of the present invention is to provide a liquid ejection head comprising a plurality of opened liquid flow passages arranged side by side and communicating with ejection orifices through which a liquid is ejected, thermal energy generating elements for generating thermal energy utilized to eject the liquid through the ejection orifices and generating bubbles in the liquid, and movable members arranged in an opposed relation to the thermal energy generating elements and having free ends displaceable upon generation of the bubbles, the thermal energy generating elements and the movable members being arranged respectively in the plurality of opened liquid flow passages, wherein a plurality of closed liquid flow passages closed at one ends corresponding to the ejection orifices are provided in at least one end side of the plurality of opened liquid flow passages in a direction in which the opened liquid flow passages are arranged, and a flow resistance is provided only in a part of the plurality of closed liquid flow passages on the side near the opened liquid flow passages.

The flow resistance may be a movable member similar to that provided in the opened liquid flow passage. When energy is applied to the energy generating element to generate and grow a bubble in a condition where the liquid is present in the liquid flow passage provided with the flow resistance in the form of a movable member, the presence of the movable member suppresses a back wave, i.e., a pressure wave, which is produced in the liquid flow passage provided with the flow resistance upon generation of the bubble and is moved toward the rear side of the liquid flow passage provided with the flow resistance. Therefore, the movement of the bubble toward the rear side of the liquid flow passage provided with the flow resistance is also suppressed. It is hence possible to prevent an ejection failure from occurring upon the bubble entering the liquid flow passage which is adjacent to the liquid flow passage provided with the flow resistance and contributes to the liquid ejection.

Still another object of the present invention is to provide a liquid ejection head comprising a plurality of opened liquid flow passages arranged side by side and communicating with ejection orifices through which a liquid is ejected, and thermal energy generating elements for generating thermal energy utilized to eject the liquid through the ejection orifices and generating bubbles in the liquid, the thermal energy generating elements being arranged respectively in the plurality of opened liquid flow passages, wherein a plurality of closed liquid flow passages closed at one ends corresponding to the ejection orifices are provided in at least one end side of the plurality of opened liquid flow passages in a direction in which the opened liquid flow passages are arranged, and a flow resistance is provided only in a part of the plurality of closed liquid flow passages on the side near the opened liquid flow passages.

Still another object of the present invention is to provide a method of manufacturing a liquid ejection head comprising the steps of preparing a body of the liquid ejection head, which comprises a plurality of liquid flow passages arranged side by side and communicating with holes at one ends thereof, and thermal energy generating elements for generating thermal energy utilized to eject a liquid through ejection orifices communicating with the holes and generating bubbles in the liquid, the thermal energy generating elements being arranged respectively in the plurality of liquid flow passages; and joining the body of the liquid ejection head and an ejection orifice plate having the ejection orifices formed therein in number less than the number of the holes to each other such that communication is maintained between a part of the holes and the ejection orifices, whereby the plurality of flow passage are divided into opened liquid flow passages communicating with the ejection orifices and closed liquid flow passages which are closed by the ejection orifice plate at one ends corresponding to the ejection orifices and are provided in at least one end side of the plurality of opened liquid flow passages in a direction in which the opened liquid flow passages are arranged.

In the liquid ejection head of the present invention, at least one closed liquid flow passage closed at one end corresponding to the ejection orifice is provided in at least one end side of the plurality of opened liquid flow passages communicating with the ejection orifices. Since the closed liquid flow passage is closed at one end corresponding to the ejection orifice and is not communicated with open air, the liquid is relatively hard to flow into the closed liquid flow passage. Accordingly, a bubble having the function of absorbing a liquid vibration caused upon ejection of the liquid is formed to extend from the interior of the closed liquid flow passage rearward. As a result, vibrations of liquid meniscuses at the ejection orifices can be suppressed, and an adverse effect upon ejection characteristics can be avoided. With the method of manufacturing the liquid ejection head according to the present invention, the liquid ejection head having the above-described construction can be manufactured with ease.

Further objects, features and advantages of the present invention will become apparent from the following description of the preferred embodiments with reference to the attached drawings.

DESCRIPTION OF THE PREFERRED EMBODIMENTS

Preferred embodiments of the present invention will be described below with reference to the drawings.

(First Embodiment)

Figure 1A:
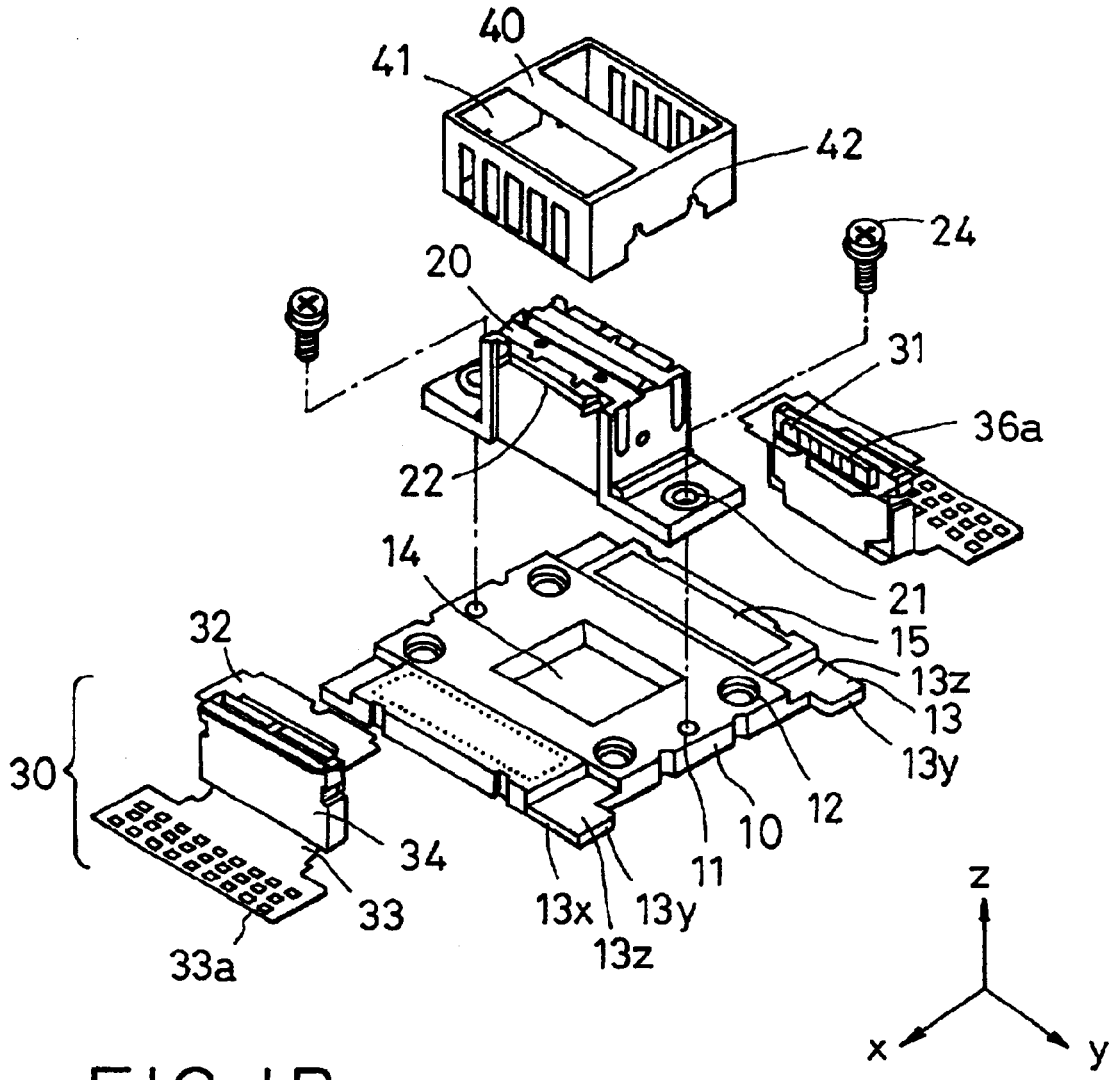
FIG. 1A is an exploded perspective view of a liquid ejection head unit according to a first embodiment of the present invention.
Figure 1B:
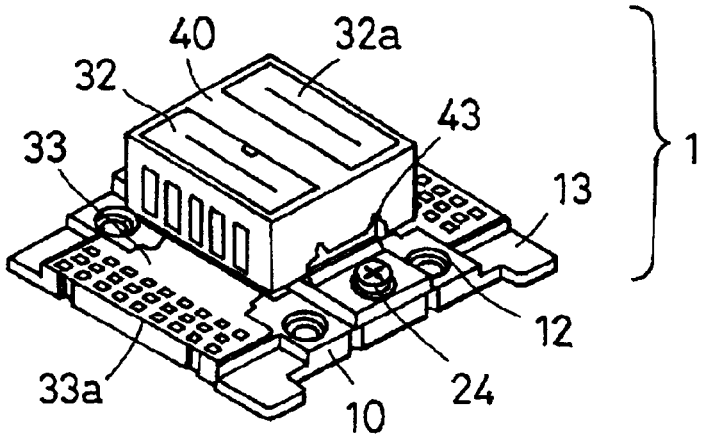
FIG. 1B is a perspective view of the liquid ejection head unit in an assembled state.
Figure 2:
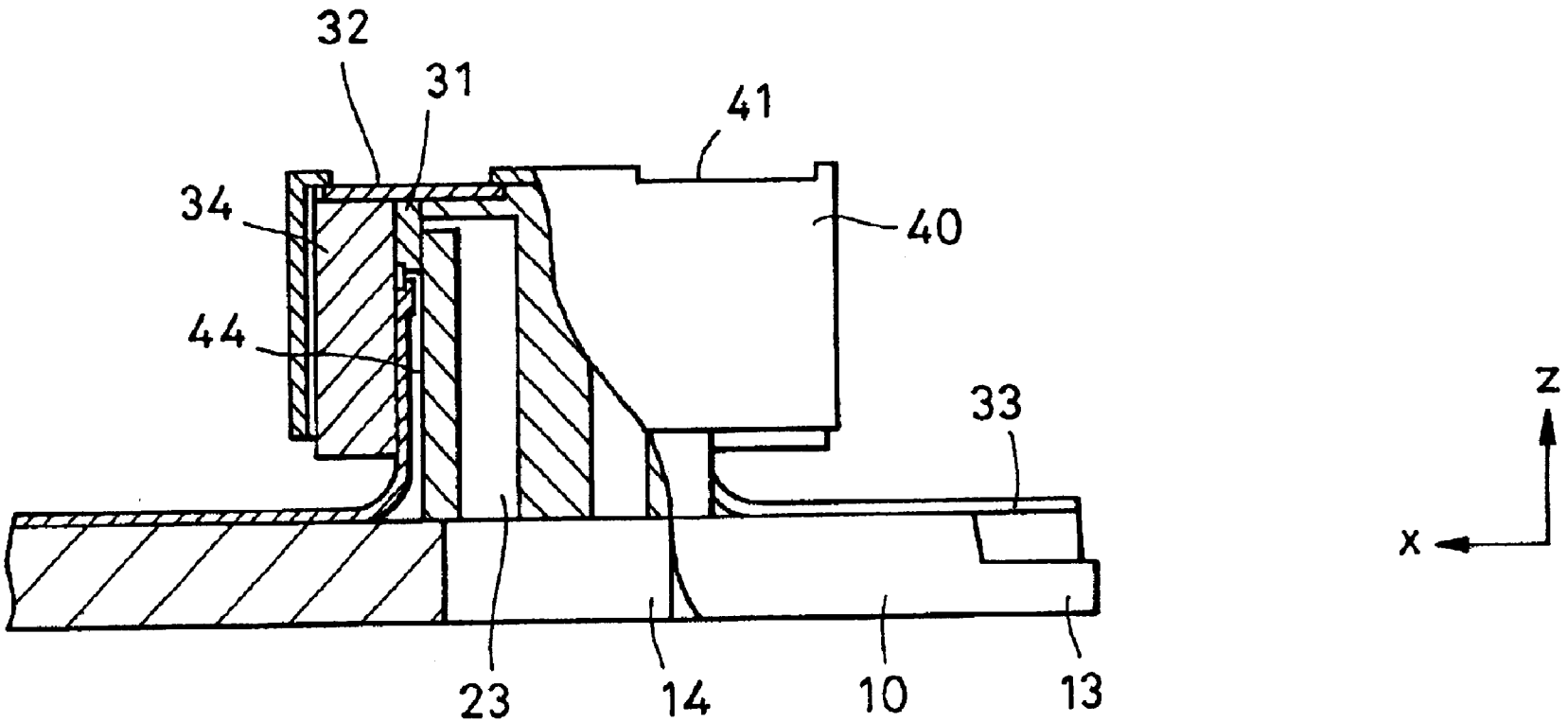
FIG. 2 is a partial front sectional view of the liquid ejection head unit of FIG. 1.
Figure 3B:
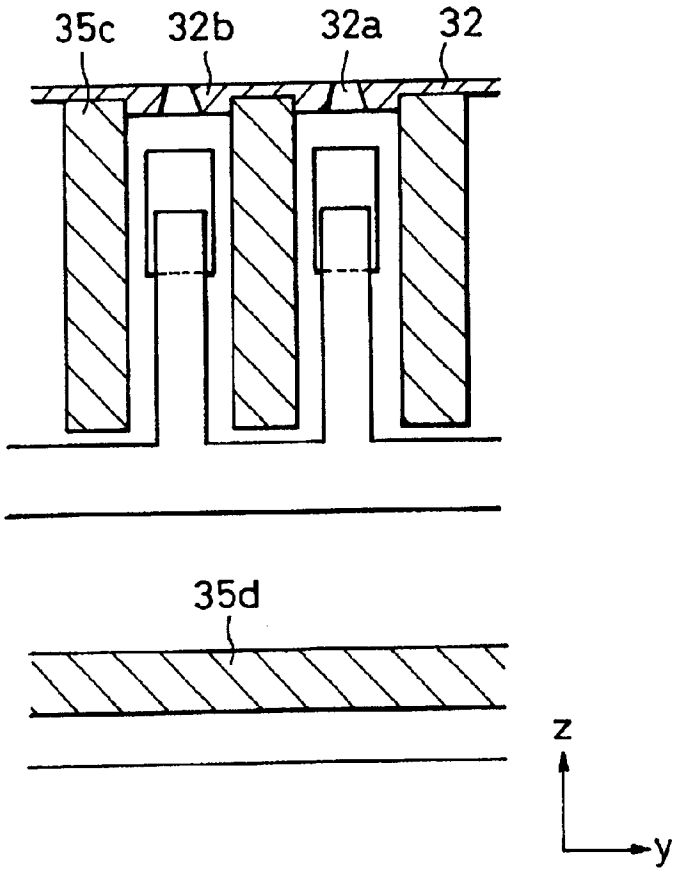
FIGS. 3A and 3B are each a schematic sectional view of a liquid ejection head chip unit in the liquid ejection head unit of FIG. 1.
Figure 3A:
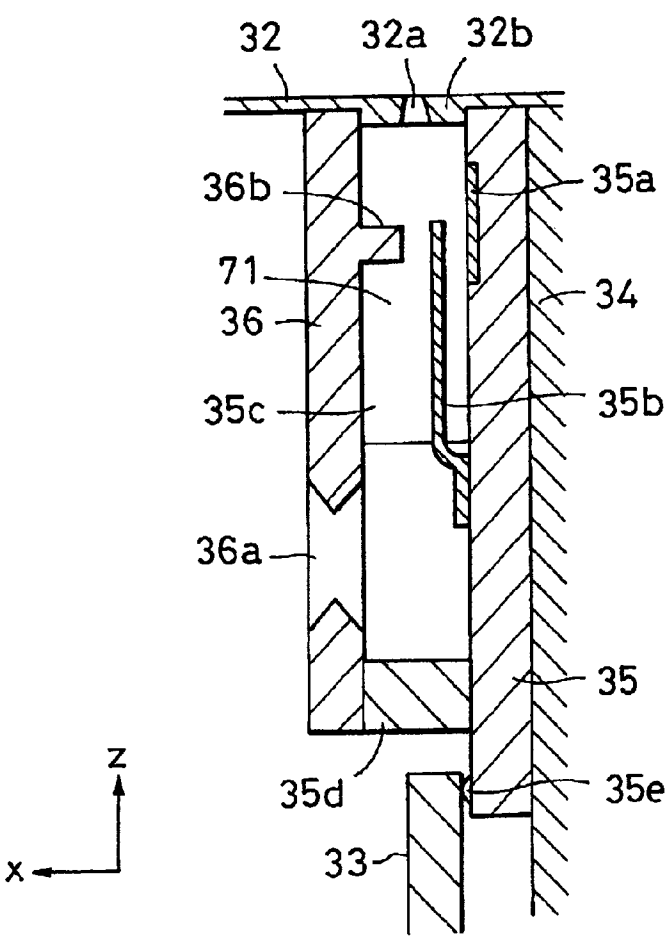
Figure 4:
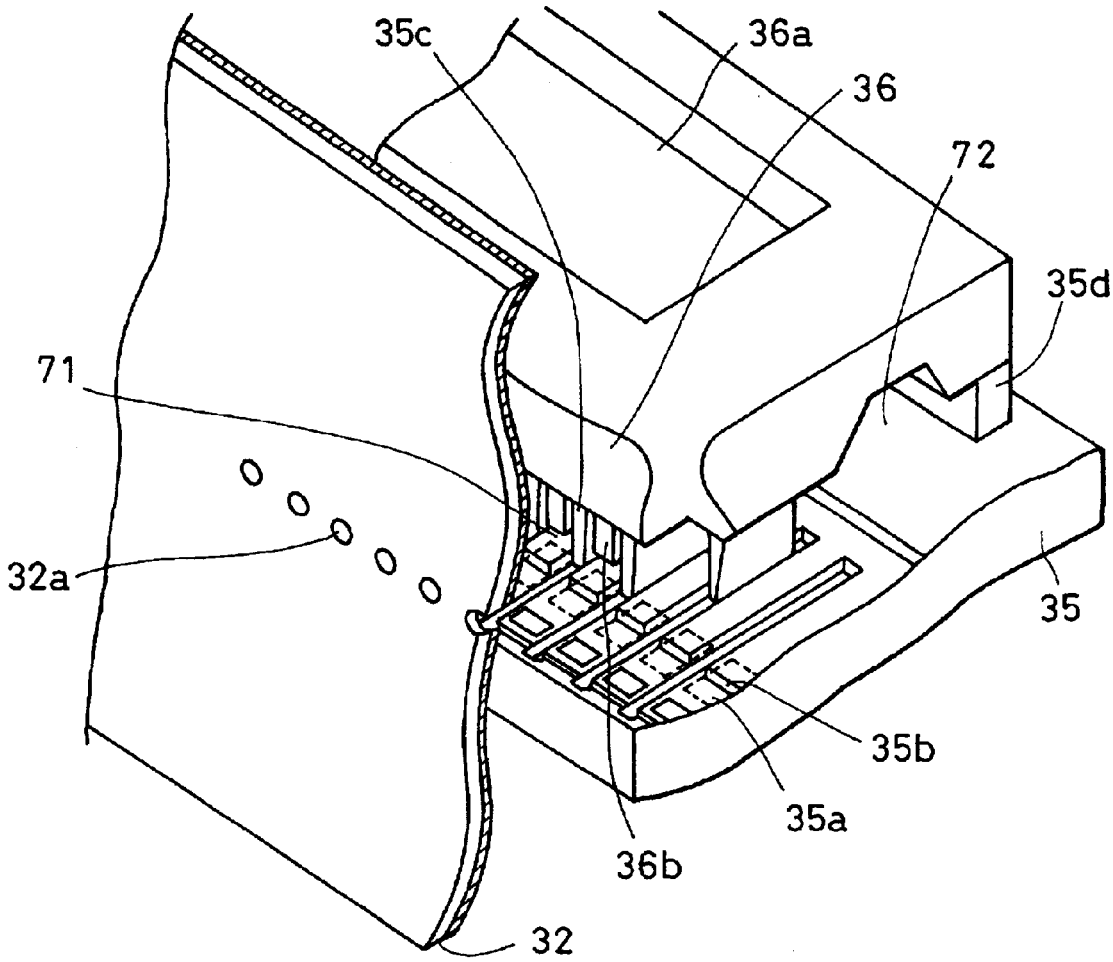
FIG. 4 is a partially broken perspective view of the liquid ejection head chip unit in the liquid ejection head unit of FIG. 1.

FIG. 1A is an exploded perspective view of a liquid ejection head unit, in which liquid ejection head chips are incorporated, according to a first embodiment of the present invention, and FIG. 1B is a perspective view of the liquid ejection head unit in an assembled state. FIG. 2 is a partial front sectional view of the liquid ejection head unit of FIG. 1. FIGS. 3A and 3B are each a schematic sectional view of a liquid ejection head chip unit in the liquid ejection head unit. FIG. 4 is a partially broken perspective view of the liquid ejection head chip unit.

A liquid ejection head unit 1 of this embodiment comprises an aluminum-made baseboard 10 serving as an entire base, a ceramic-made frame 20 uprightly mounted to the center of the baseboard 10 and providing a T-form in the mounted state as viewed from the front, two chip units 30 joined to opposite lateral surfaces of the frame 20, and a stainless-made front cap 40 joined to both the frame 20 and the two chip units 30 so as to cover them from above.

The baseboard 10 has portions recessed from its upper surface at four corners. Front-side two of the four recessed portions project slightly forward and sideward to provide body mount references 13. More specifically, of the mount references 13, an end surface projecting to the left serves as an X-direction mount reference 13*x*, an end surface projecting forward serves as a Y-direction mount reference 13*y*, and an upper surface serves as a Z-direction mount reference 13*z*. Those three surfaces are finished to a predetermined level of plane accuracy and employed as positioning references when the liquid ejection head unit 1 is mounted to a main body. Mount holes 12 used for mounting the liquid ejection head unit 1 to a head cartridge, described later, are bored through the baseboard 10 at four corners of its central raised portion. An opening 14 is formed at the center of the baseboard 10 and receives a liquid supply section of the head cartridge. Screw holes 11 are formed in the baseboard 10 at positions forward and backward of the opening 14, and screws 24 are engaged in the screw holes 11 for mounting the frame 20.

The frame 20 has an upwardly projecting central portion and a flat-plate mount portions on the front and back sides of the central portion. Frame mount holes 21 are bored through the flat-plate mount portions. The frame 20 is joined to the baseboard 10 by engaging and fastening the screws 24 into the screw holes 11 of the baseboard 10 through the frame mount holes 21. Inside a central portion of the frame 20, at least two liquid supply passages 23 are formed to extend upward from a bottom surface and are communicated with liquid supply ports 22, which are opened in both the lateral (left and right) surfaces of the frame 20. Openings at lower ends of the liquid supply passages 23 are positioned in the opening 14 of the baseboard 10. The chip units 30 are joined to the left and right surfaces of the frame 20 in which the liquid supply ports 22 are formed.

Each of the chip units 30 comprises a liquid ejection head chip 31 for ejecting a liquid, a flexible cable 33 electrically connected to the liquid ejection head chip 31 and transmitting a driving signal to it, and an aluminum-made base plate 34 for supporting the head chip 31 and the flexible cable 33.

The liquid ejection head chip 31 includes a plurality of heaters (ejection energy generating elements) 35*a* arranged at predetermined intervals for heating the liquid and generating bubbles. The head chip 31 also includes a heater board 35 in which electrical wires (not shown) are formed for transmitting a signal to each of those heaters 35*a*. On the heater board 35, there are formed flow passage walls 35*c* forming sidewalls of a liquid flow passage 71 extending over each heater 35*a*, and a liquid chamber wall 35*d* forming a sidewall of a common liquid chamber through which the liquid is supplied to each liquid flow passage 71. A top plate 36 made of Si is bonded to upper ends of the flow passage walls 35*c* and the liquid chamber wall 35*d*. A liquid inlet port 36*a* is bored through the top plate 36 for communication with the common liquid chamber. Bumps 35*e* are provided in a portion of the heater board 35 which is extended downward beyond the common liquid chamber, and the flexible cable 33 is joined to the bumps 35*e* for electrical connection.

In each liquid flow passage 71, as shown in FIGS. 3 and 4, a movable member 35*b* made of SiN is formed in a cantilevered state. The movable member 35*b* has a movable portion, which is located above the heater 35*a* with a predetermined spacing left between them and which is displaceable with a pressure caused upon generation of bubbles. On one side of the top plate 36 defining the liquid flow passage 71, a displacement restricting member 36*b* is formed to project into the liquid flow passage 71 to such an extent that its distal end is located above the movable portion of each movable member 35*b* with a predetermined spacing left between them, thereby restricting a displacement of the movable member 35*b*. The provision of the movable member 35*b* and the displacement restricting member 36*b* is advantageous in that the pressure caused upon generation of bubbles with energization of the heater 35*a* can be effectively introduced toward an ejection orifice 32*a* and the liquid can be efficiently ejected.

An orifice plate 32 is joined to upper ends, as viewed in FIGS. 1 to 3 (Z-direction), of the heater board 35 and the top plate 36 to close the liquid flow passages 71 formed between them. A plurality of ejection orifices 32*a* are bored through the orifice plate 32 for communication with the liquid flow passages 71. The orifice plate 32 has water repellency enough to ensure reliable liquid ejection by preventing the liquid from attaching to a liquid ejection surface of the orifice plate 32 and residing there. On a joining surface of the orifice plate 32, projections 32*b* are formed in a one-to-one relation to the liquid flow passages 71 and projected so as to enter the corresponding liquid flow passages 71. The provision of the projections 32*b* contributes to positioning the liquid flow passages 71 and the ejection orifices 32*a* with high accuracy, and to increasing the joining strength of the orifice plate 32.

Figure 5:
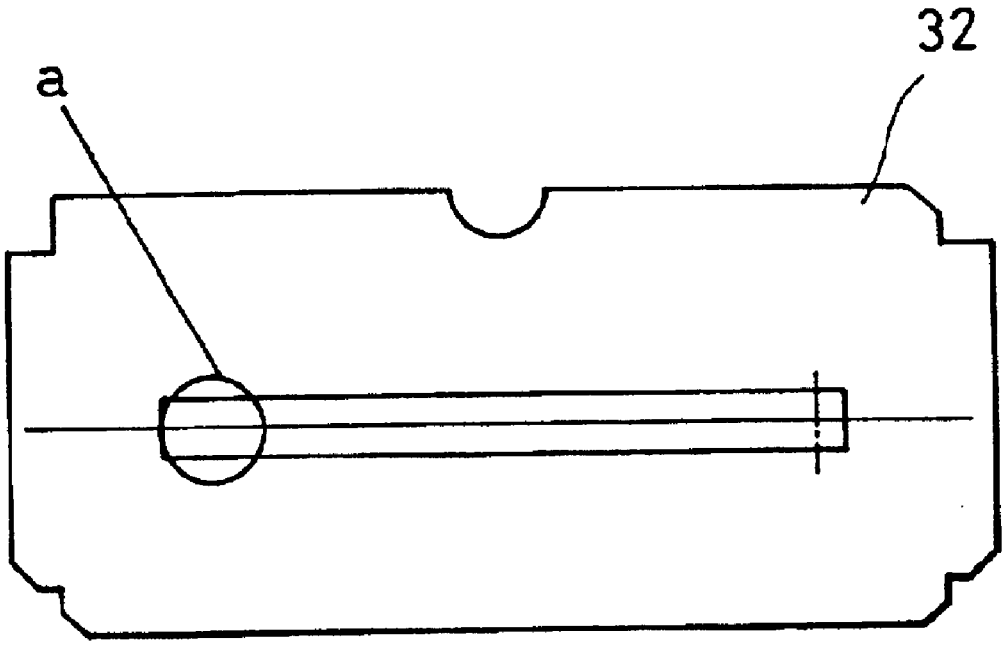
FIG. 5 is a plan view of an orifice plate in FIG. 1.
Figure 6:
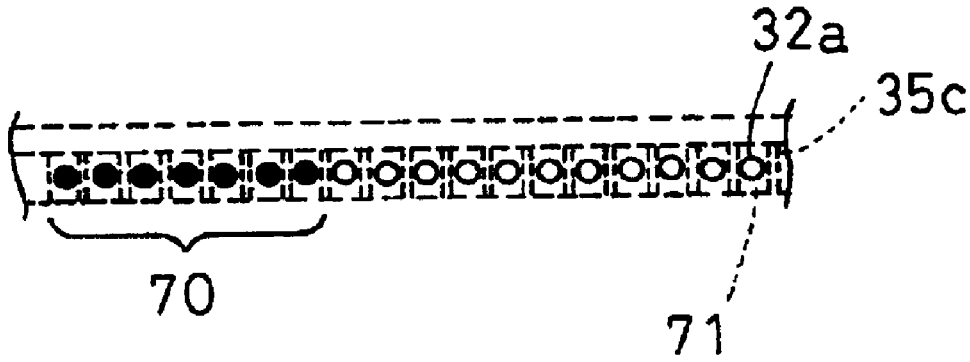
FIG. 6 is an opened-up enlarged view of an area a in FIG. 5.
Figure 7A:
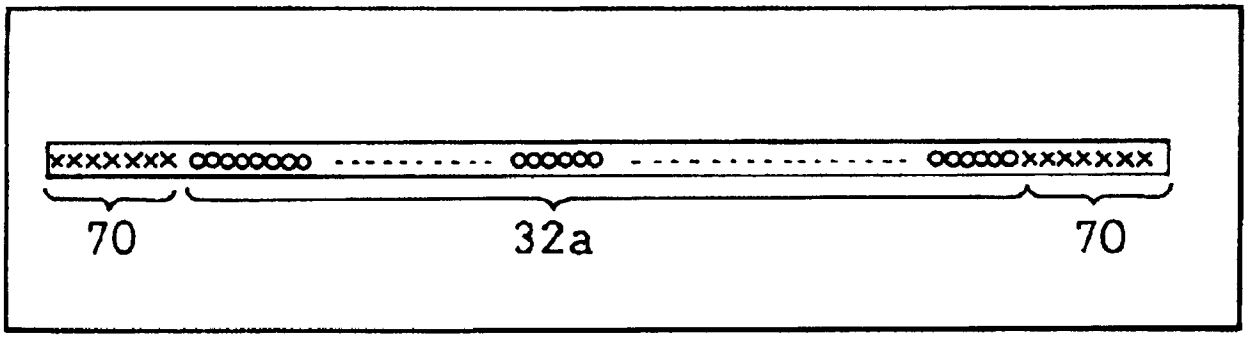
FIGS. 7A and 7B are respectively a schematic front view and a schematic plan sectional view of a liquid ejection head chip.
Figure 7B:
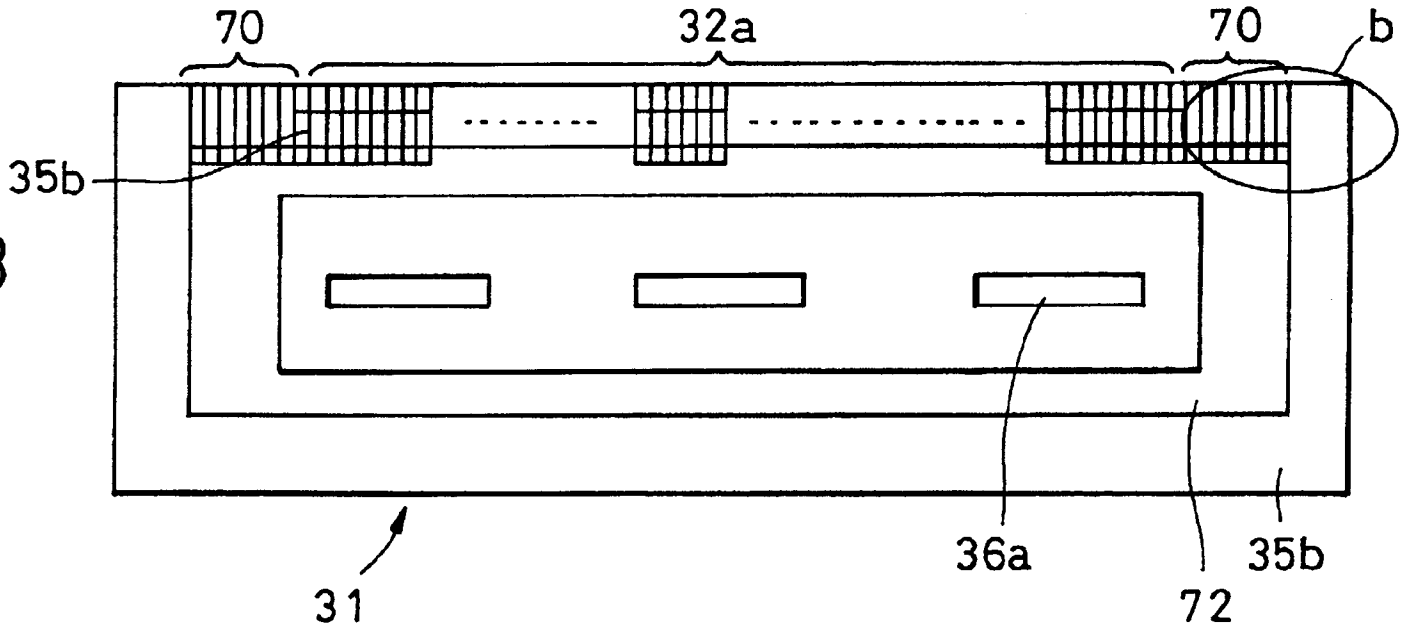
Figure 8:
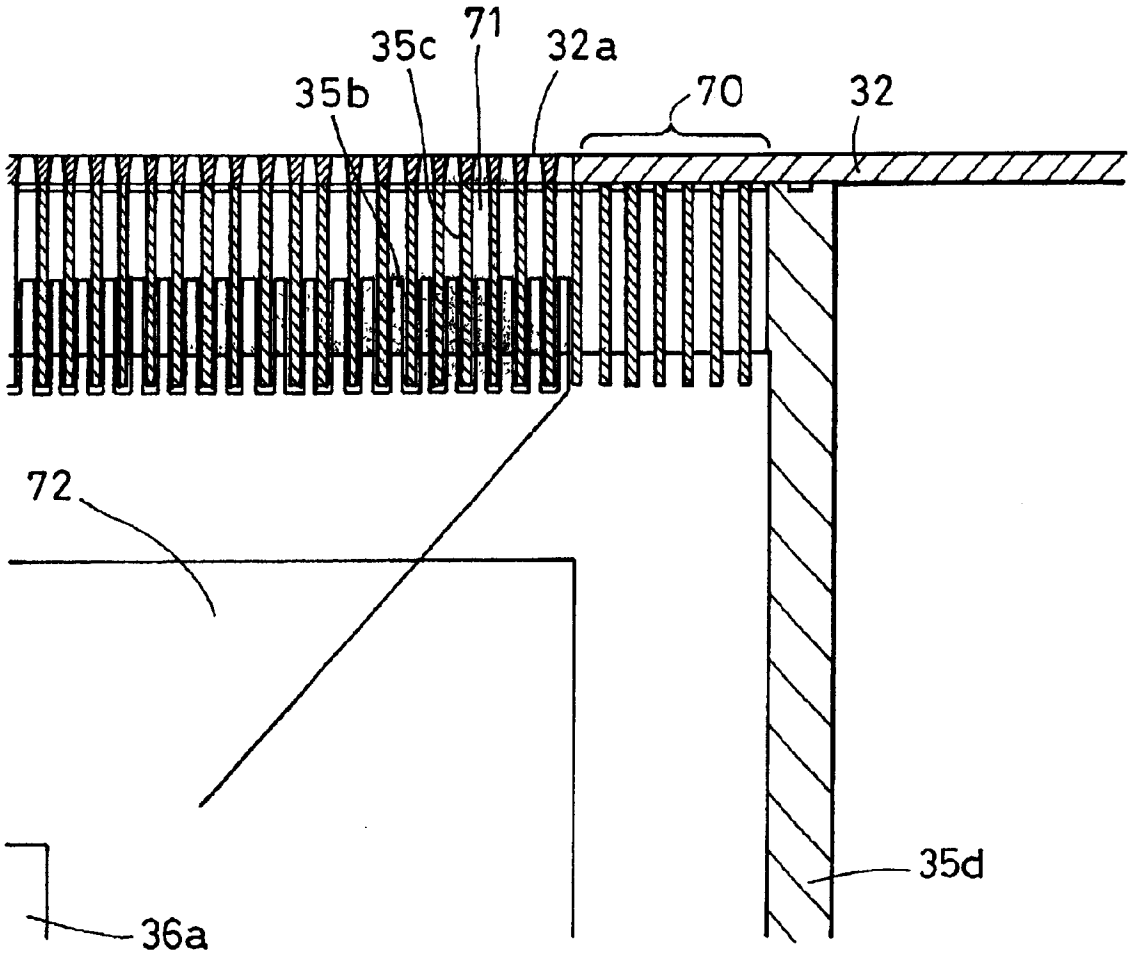
FIG. 8 is an enlarged view of an area b in FIG. 7.

FIG. 5 is a plan view of the orifice plate 32, and FIG. 6 is an opened-up enlarged view of an area a of the orifice plate 32 in FIG. 5. FIGS. 7A and 7B are respectively a schematic front view and a schematic plan sectional view of the liquid ejection head chip. FIG. 8 is an enlarged view of an area b in FIG. 7. Note that, in FIG. 7A, marks × denote the positions of closed flow passages 70.

In the orifice plate 32, the ejection orifices 32*a* corresponding to total 14 ones of the liquid flow passages 71, i.e., to 7 passages on each of the opposite sides thereof, are not formed. Stated otherwise, the number of the ejection orifices 32*a* formed in the orifice plate 32 is smaller than the number of the liquid flow passages 71, i.e., the number of holes formed in a body of the liquid ejection head chip 31. The seven liquid flow passages on each of the opposite sides are not communicated with the atmosphere, whereby closed flow passages 70 not contributing to the liquid ejection are formed.

Figure 9:
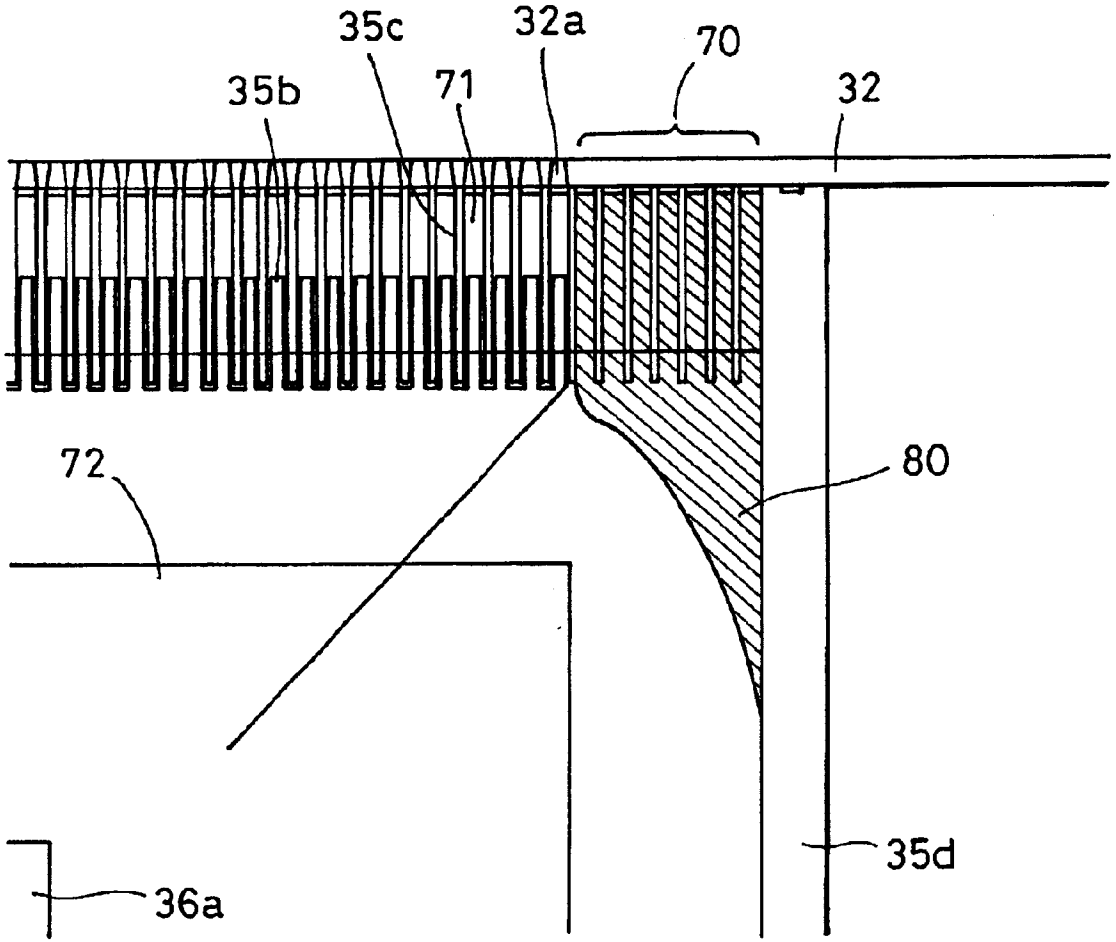
FIG. 9 is a view, similar to FIG. 8, showing a bubble region generated behind closed flow passages.
Figure 10:
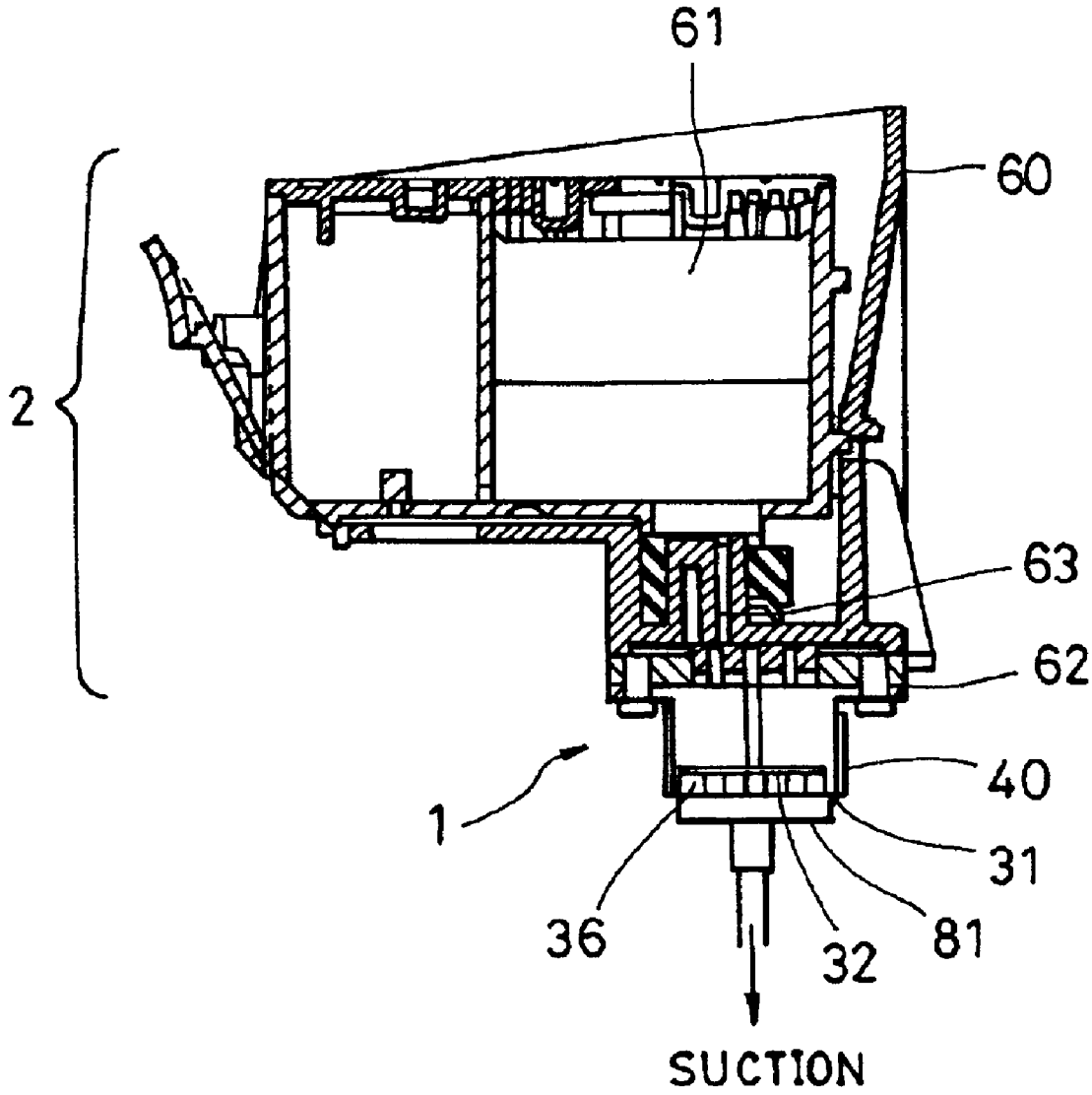
FIG. 10 is a side sectional view of a head cartridge according to the first embodiment of the present invention, the cartridge being in a suction state.
Figure 11A:
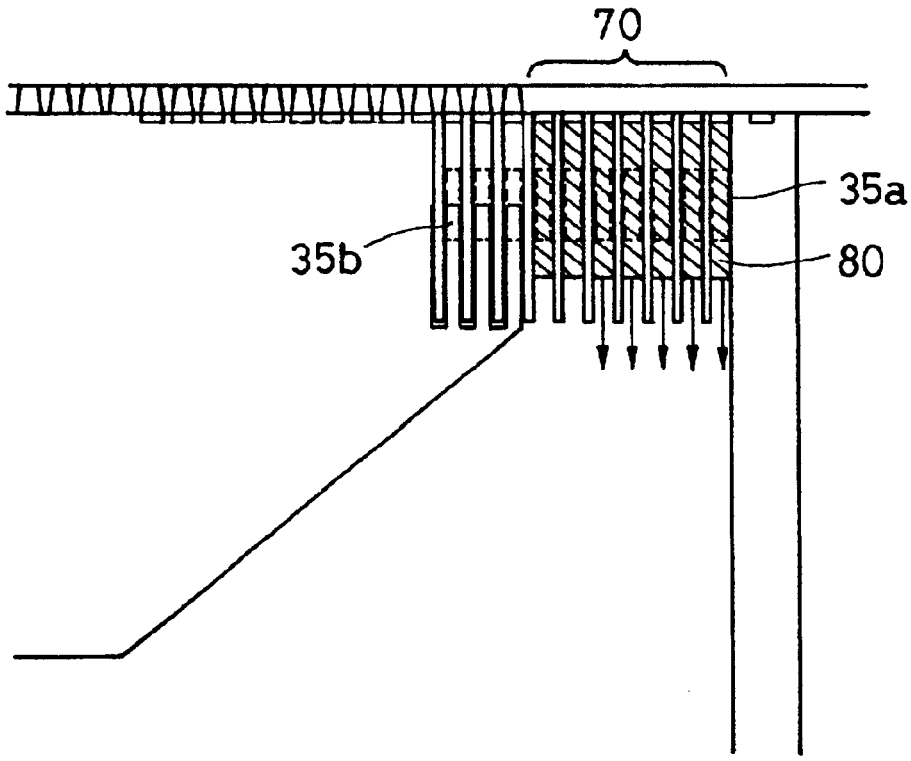
FIGS. 11A and 11B are views, similar to FIG. 9, showing a bubble region generated and grown upon heating by heaters provided in closed flow passages.
Figure 11B:
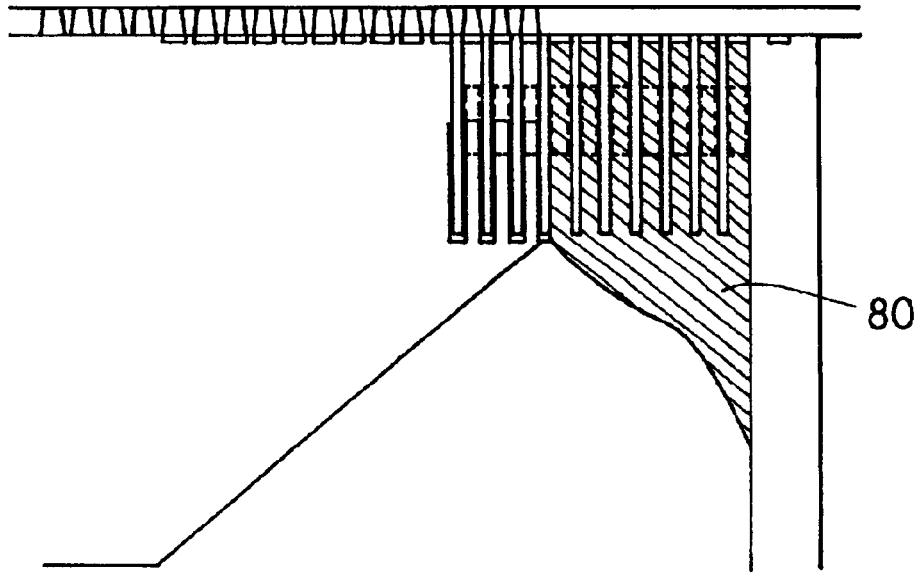

FIG. 9 is an enlarged view of the area b in FIG. 7, showing a state in which a bubble region is generated behind the closed flow passages by suction of a liquid through the ejection orifices. FIG. 10 is a side sectional view of a head cartridge according to the first embodiment of the present invention, showing a restoration (suction) state of the liquid ejection head unit. FIGS. 11A and 11B are views, similar to FIG. 9, showing a bubble region 80 generated and grown upon heating by the heater.

Note that, while the liquid chamber wall 35*d*, the flow passage walls 35*c* and the orifice plate 32, i.e., the components of the liquid ejection head chip 31, are hatched in the enlarged plan sectional view of FIG. 8, the bubble region 80 is hatched in the enlarged plan sectional views of FIGS. 9, 11A and 11B instead of hatching the components of the liquid ejection head chip 31, because those drawings are referred to for explaining the bubble region 80 formed behind the closed flow passages 70.

In the liquid ejection head chip 31, the liquid is filled in a liquid chamber 72 and the liquid flow passages 71 by suction through the ejection orifices 32*a* in a manufacturing process described later. At that time, the liquid is relatively hard to flow into 7 ones of the liquid flow passages 71 formed in the liquid ejection head chip 31 on each of the opposite sides thereof, i.e., into the closed flow passages 70, which are closed by portions of the orifice plate 32 not having the ejection orifices 32*a* and which are not communicated with the atmosphere. As shown in FIG. 9, therefore, the bubble region 80 is formed in and behind the closed flow passages 70 as indicated by hatching. The bubble region 80 functions as a buffer for absorbing a liquid vibration that causes meniscus vibrations in the ejection orifices 32*a*. In other words, if the bubble region 80 is not formed, the liquid vibration would be imposed on a liquid meniscus formed in each of the ejection orifices 32*a* subjected to the atmospheric pressure, thereby giving rise to a meniscus vibration. In the liquid ejection head chip 31 of this embodiment, however, the bubble region 80 formed with the provision of the closed flow passages 70 absorbs the liquid vibration and prevents the liquid vibration from being transmitted to the liquid meniscus. As a result, the occurrence of meniscus vibration can be avoided.

When the bubble region 80 is enlarged in excess of a necessary volume due to air having entered the liquid ejection head chip 31 from the outside, extra bubbles are sucked and discharged, as shown in FIG. 10, by a means for restoring the ejection characteristics of the liquid ejection head unit 1. The head cartridge shown in FIG. 10 is constructed by mounting the liquid ejection head unit 1 to a liquid container holder 60 for holding a liquid container 61 in which the liquid is filled. The liquid is supplied from the liquid container 61 to the liquid ejection head chip 31 through a liquid introducing passage 63 and a liquid supply passage 62. Also, a suction cap 81 is one component of the restoring means provided in a liquid ejection device (not shown), and it is fitted to the liquid ejection head chip 31 for capping the front surface of the orifice plate 32. By operating a suction means (not shown), such as a pump, in that condition, unnecessary air in the liquid flow passages 71 and the liquid chamber 72, the liquid having increased viscosity, etc. are sucked to the outside.

On the other hand, although the bubble region 80 is stably maintained while intimately contacting the liquid chamber wall 35*d*, the volume of the bubble region 80 is sometimes reduced to such an extent that the bubble region 80 is not formed in the closed flow passages 70 in a necessary volume. In such a case, as shown in FIG. 11A, the heaters 35*a* provided in the closed flow passages 70 are heated to evaporate the liquid for generating the bubble region 80. Then, as shown in FIG. 11B, the heaters 35*a* are continuously heated to grow the bubble region 80 until a desired volume of the bubble region 80 is formed. As a result, the bubble region 80 can be always maintained in volume sufficient to properly function as a buffer.

Additionally, the movable members 35*b* are not provided in those ones of the liquid flow passages 71 which correspond to the closed flow passages 70. The reason is that the closed flow passages 70 do not take part in ejection of the liquid, and that the liquid in the closed flow passages 70 can be more efficiently heated to generate bubbles for forming the bubble region 80 which functions as a buffer. In other words, with that arrangement, bubbles can be generated and grown rearward, i.e., toward the liquid chamber 72, in a direction away from the ejection orifices 32*a* without being impeded by the movable member 35*b*.

The liquid ejection head chip 31 thus constructed and the flexible cable 33 are joined to the base plate 34, as shown in FIG. 1, thereby constituting the liquid ejection head chip unit 30. Then, the chip unit 30 is joined to each of both the sides of the frame 20 by an adhesive such that the liquid inlet port 36*a* of the liquid ejection head chip 31 is communicated with the liquid supply port 22 of the frame 20. The adhesive is coated over not a surface of each liquid ejection head chip 31 in which the liquid inlet port 36*a* is formed, but over surfaces of the liquid ejection head chip 31 on both sides of that uncoated surface and areas of both lateral surfaces of the frame 20 in which the liquid supply ports 22 are not formed. One of the chip units ejecting a black ink is arranged on one side of the frame 20, and the other chip unit ejecting inks of three colors, i.e., yellow, magenta and cyan, is arranged on the other side of the frame 20. In the chip unit ejecting the inks of three colors, the common liquid chamber and the liquid inlet port 36*a* are formed in a divided structure for each of the three colors.

A contact pad 33*a* for electrical connection to the main body side is formed at one end of the flexible cable 33 opposite to the other end, to which the liquid ejection head chip 31 is joined. The flexible cable 33 is constructed by forming a printed wire pattern on a TAB (Tape Automated Bonding), and has flexibility. The flexible cable 33 is arranged to extend downward along the base plate 34 and is then bent to extend horizontally such that its end portion, in which the contact pad 33*a* is formed, is positioned on an upper surface of the baseboard 10. The flexible cable 33 is joined to the upper surface of the baseboard 10 through a hot melt sheet 15.

The front cap 40 has two openings 41 formed therein, each of which is positioned above the orifice plate 32 and is smaller than the orifice plate 32. Edges of the opening 41 of the front cap 40 are located on four sides of the orifice plate 32 so as to avoid those four sides from being exposed externally. An upper surface of the front cap 40 is Teflon-coated and has water repellency substantially at the same level as that of the orifice plate 32. UV adhesive holes 42 are formed in front and rear surfaces of the front cap 40. The UV adhesive holes 42*a* are each shaped such that the hole extends upward from a lower end of the front or rear surface of the front cap 40, is narrowed in its intermediate portion to have a reduced width, and then further extends upward from the narrowed intermediate portion in the circular form having a diameter greater than the reduced width. A UV adhesive 43 is applied and hardened in the circular portion of the UV adhesive hole 42 at an upper end thereof. With that arrangement, even when a load is imposed on the front cap 40, the front cap 40 is avoided from moving up and down because the hardened UV adhesive 43 is caught by an upper edge of the circular portion and the narrowed intermediate portion of the UV adhesive hole 42. Further, the front cap 40 is fixed in place by a sealant 44 poured into gaps between the frame 20 and the chip units 32.

Thus, the front cap 40 is firmly fixed in a condition covering the orifice plate 32 so as to surround it and projecting upward of the orifice plate 32. With the provision of the front cap 40 constructed and arranged as described above, the orifice plate 32 having the ejection orifices 32*a* is protected against external forces that may damage or deform the orifice plate 32 and adversely affect the accuracy in liquid ejection. Also, because of having high durability, the Teflon-coating formed on the upper surface of the front cap 40 does not lose water repellency and hardly deteriorates over time even when subjected to external forces.

Figure 12:
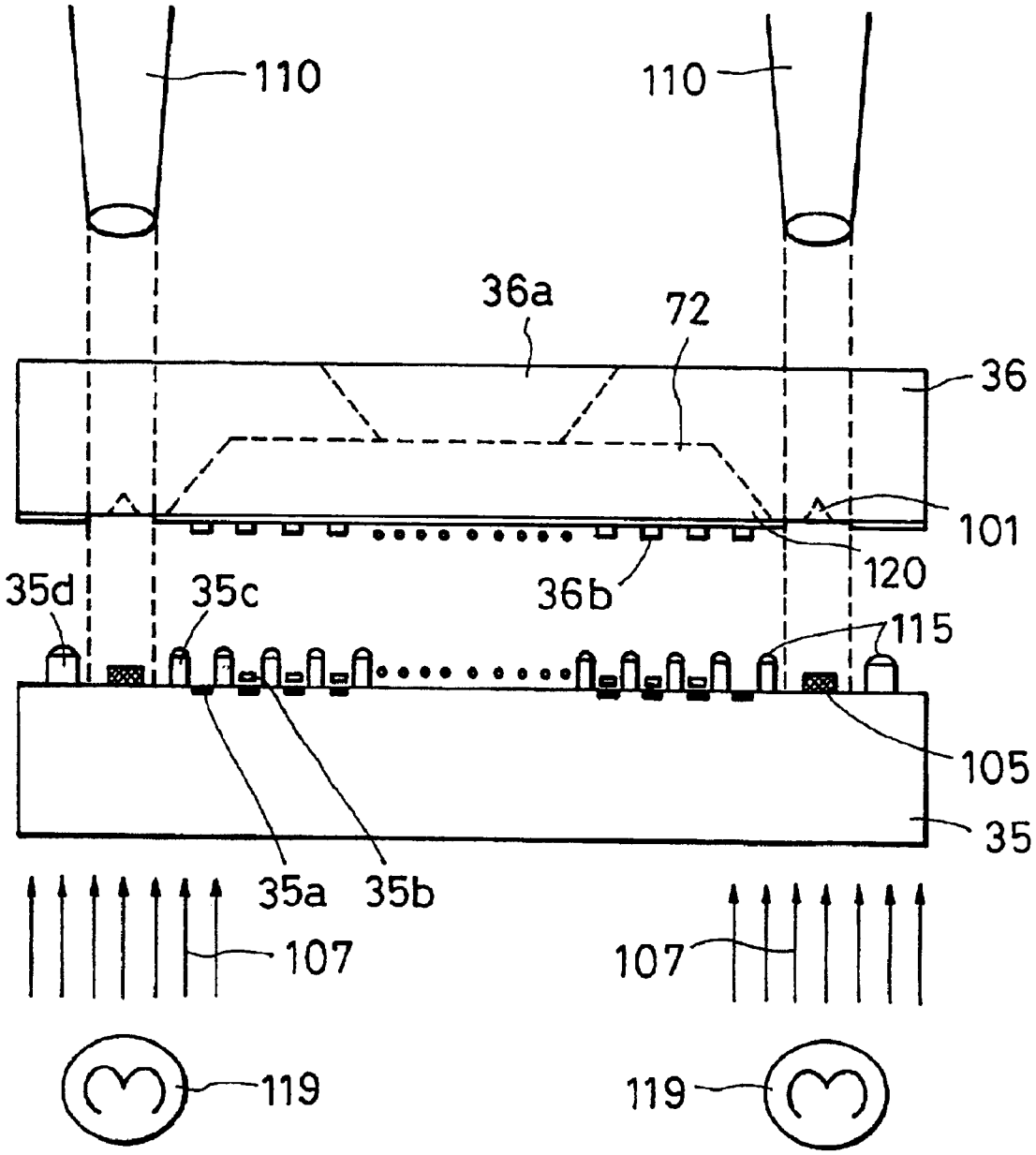
FIG. 12 is a schematic view for explaining a method of manufacturing the liquid ejection head chip in the liquid ejection head unit of FIG. 1.

The following description is made of a method of manufacturing the liquid ejection head chip with reference to FIG. 12 and a method of manufacturing the liquid ejection head unit with reference to FIGS. 13A to 13F.

First, the movable members 35*b* are formed on the heater board 35 in which the heaters 35*a* have already been formed. Then, the flow passage walls 35*c* are formed by the photolithography. Further, heater-board-side alignment marks 105 for positioning are formed on the heater board 35 beforehand. The flow passage walls 35*c* are formed of a photosensitive resin that is optionally selectable. In this embodiment, a negative resist NANO TMXP SU-8 (trade name) made by Micro Chemical Co., Ltd. was employed to form the flow passage walls 35*c*.

The top plate 36 is made of silicon formed to have the crystal azimuth (100) with respect to its surface joined to the heater board 35. The liquid inlet port 36*a* and the liquid chamber 72 are formed in the top plate 36 by anisotropic etching.

A silicon substrate (100) is fabricated through steps (1) to (6) given below, and then subjected to polishing at both sides thereof. (1) An ingot obtained through azimuthal processing is cut and sliced into wafers. (2) The sliced wafers are lapped. (3) Peripheral edges of each wafer are chamfered. (4) The wafer is subjected to surface treatment by chemical etching. (5) Mirror polishing is performed on both the sides of the wafer at the same time or on one side thereof at one time. (6) The wafer is subjected to cleaning.

A thermal oxidation film is formed on the silicon substrate (100) fabricated through the steps described above. The liquid inlet port 36*a* and the liquid chamber 72 are formed in the silicon substrate (100) by utilizing the thermal oxidation film as a mask. The thermal oxidation film is patterned by the photolithography. After patterning the thermal oxidation film, the silicon substrate (100) is subjected to anisotropic etching at temperature of 80° C. using an etchant TMAH-2 (trade name) made by Kanto Kagaku Co., Ltd. The liquid inlet port 36*a* and the liquid chamber 72 are formed concurrently by the anisotropic etching. At the same time as when forming the liquid inlet port 36*a* and the liquid chamber 72, top-plate-side alignment marks 101 are also formed which are to be aligned with the heater-board-side alignment marks 105 formed on the heater board 35.

Next, underlying members 120 for the displacement restricting members 36*b* and the displacement restricting members 36*b* are formed in the top plate 36. This step is carried out by using a dry film resist and patterning it. More specifically, a dry film resist for a first layer is coated, and an image of the underlying members 120 is formed upon exposure. Then, a dry film resist for a second layer is coated, and an image of the displacement restricting members 36*b* is formed upon exposure. Thereafter, the underlying members 120 and the displacement restricting members 36*b* are formed by developing the formed images.

Joining between the heater board 35 and the top plate 36 will be described below.

First, an adhesive 115 is thermally transferred to upper ends of the flow passage walls 35*c* and the liquid chamber wall 35*d*. Then, the adhesive 115 is activated upon UV irradiation.

Subsequently, the heater board 35 and the top plate 36 are set in a positioning apparatus (not shown) such that the heater board 35 is positioned on the lower side and the top plate 36 is positioned on the upper side. Then, infrared rays 107 are irradiated from infrared lamps 119 toward the heater board 35 from the lower side, while precise alignment between the heater-board-side alignment marks 105 and the top-plate-side alignment marks 101 is confirmed from the upper side of the top plate 36 using IR optical microscopes 110. After thus positioning the heater board 35 and the top plate 36, the heater board 35 and the top plate 36 are bonded together by thermal compression bonding. Note that the liquid ejection head chip 31 thus obtained by bonding the heater board 35 and the top plate 36 together is fabricated not one but in plural number in one cycle of manufacturing process. A plurality of the liquid ejection head chips 31 are fabricated at the same time by bonding a heater board blank 50 (see FIG. 13A), in which a plurality of heater boards 35 are formed, and a top plate blank 51 (see FIG. 13A), in which a plurality of top plates 36 are formed, to each other.

FIGS. 13A to 13F are schematic perspective views for explaining respective steps of manufacturing the liquid ejection head chip unit.

Figure 13A:
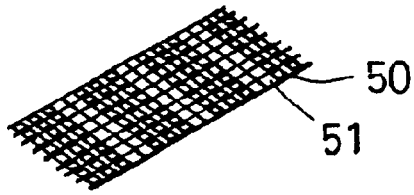
FIGS. 13A to 13F are schematic perspective views for explaining respective steps of the method of manufacturing the liquid ejection head chip unit in the liquid ejection head unit of FIG. 1.

First, as shown in FIG. 13A, the heater board blank 50, in which the heaters 35*a*, the movable members 35*b* provided in areas other than those defining the closed flow passages 70, the flow passage walls 35*c* and the liquid chamber wall 35*d* are formed corresponding to a plurality of head chips, is joined to the top plate blank 51, in which the liquid inlet port 36*a* and the displacement restricting members 36*b* are formed corresponding to the plurality of head chips. The joined blanks 50, 51 are cut and separated into the plurality of head chips using a die or the like. With that process, a large number of head chips can be efficiently manufactured.

Figure 13B:
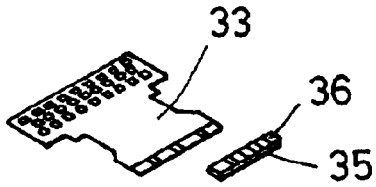
Figure 13C:
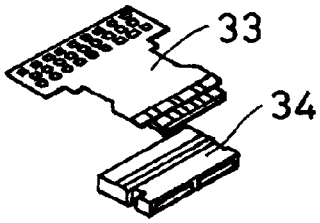
Figure 13D:
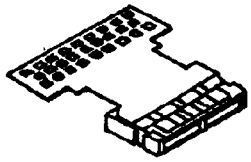

Next, as shown in FIGS. 13B and 13C, the flexible cable 33 is placed on the bumps 35*e* of the heater board 35 (see FIG. 3B), and it is joined to the heater board 35 upon fusion of the bumps 35*e*. Then, as shown in FIGS. 13C and 13D, an assembly of the heater board 35 and the flexible cable 33 is joined to the base plate 34.

Figure 13E:
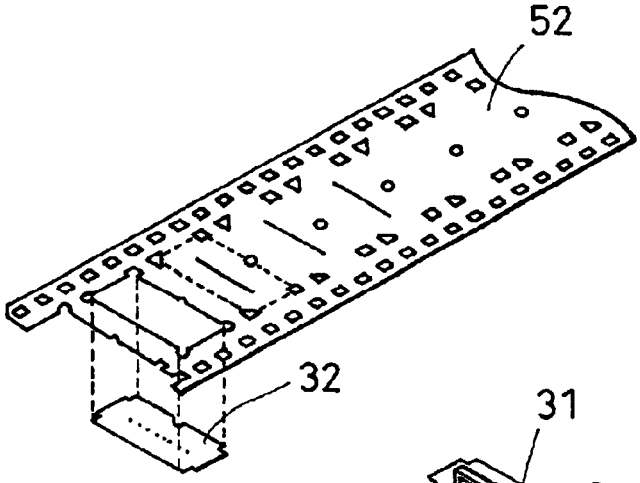

As shown in FIG. 13E, the orifice plate 32 is manufactured from a tape-like OP (orifice plate) sheet 52. More specifically, the OP sheet 52 is fed so as to pass a laser machining apparatus (not shown) and a cutter (not shown) in this order. The laser machining apparatus forms the ejection orifices 32*a* in positions corresponding to the liquid flow passages 71 except for the closed flow passages 70, and also forms the projections 32*b*. The cutter cuts the OP sheet 52 into a predetermined shape. The individual orifice plates 32 are thereby obtained. With that process, a large number of orifice plates 32 can be efficiently manufactured. At that time, the laser machining is carried out using a mask in which portions having transmittances of 100%, 30% and 0% are formed in a predetermined pattern. By using such a mask, the ejection orifices 32*a* penetrating the OP sheet 52 are formed by a laser beam having passed the mask portion of 100% transmittance. Another laser beam having passed the mask portion of 30% transmittance cuts the OP sheet 52 to have a relatively small thickness. As a result, the projections 32*b* are formed between areas of the OP sheet 52, which correspond to the mask portion of 0% transmittance and are not cut by a laser beam.

Figure 13F:
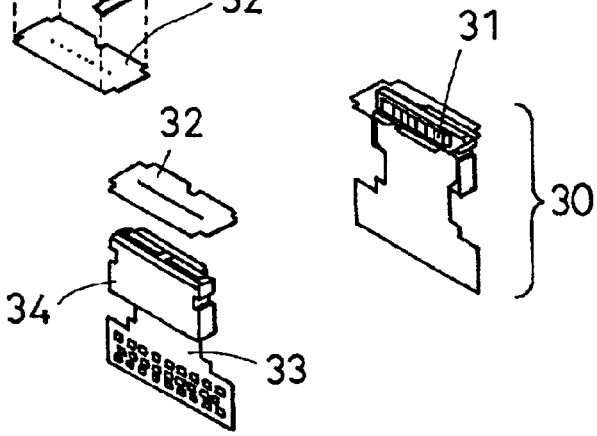

Subsequently, as shown in FIG. 13F, the orifice plate 32, in which the ejection orifices 32*a* are formed in number smaller than the total number of the liquid flow passages 71 by the number of the closed flow passages 70, is joined to the heater board 35 and the top plate 36 so as to close the opening of each liquid flow passage defined between them. The manufacturing process of the chip unit 30 is thus completed. At that time, since the projections 32*b* are formed in the orifice plate 32, the ejection orifices 32*a* can be easily positioned relative to the liquid flow passages with high accuracy by inserting the projections 32*b* in the liquid flow passages. Also, an adhesive used for joining of the orifice plate 32 can be avoided from entering the liquid flow passage. It is hence possible to prevent the ejection accuracy from being adversely affected by an adhesive having entered the liquid flow passages.

The liquid ejection head chip 31 formed as described above is filled with a preservation liquid until it is employed by users, for protecting the interior of the liquid ejection head chip 31 against deterioration caused by intrusion of dust and oxidation upon exposure to open air.

Figure 14A:
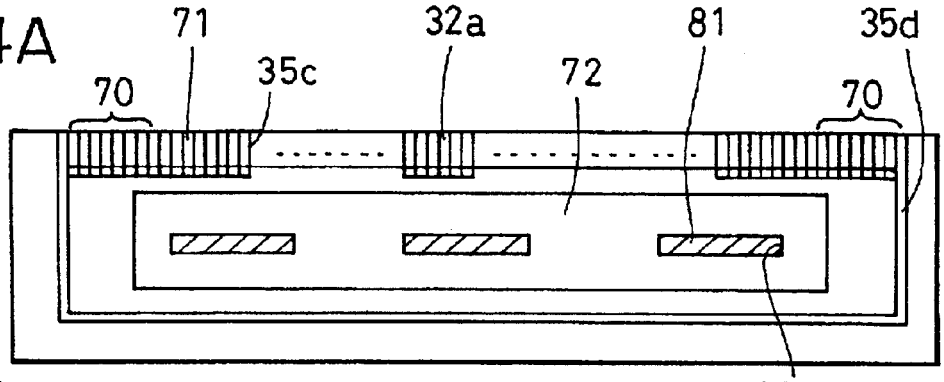
FIGS. 14A to 14C are schematic views for explaining of a process for filling a liquid into the liquid ejection head chip in the first embodiment of the present invention.
Figure 14B:
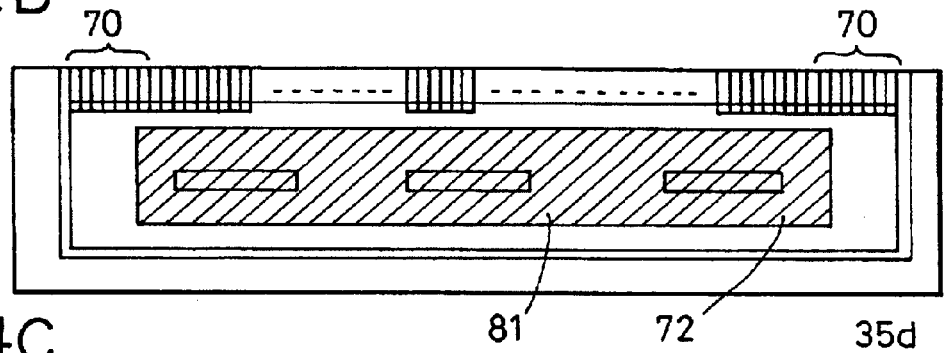
Figure 14C:
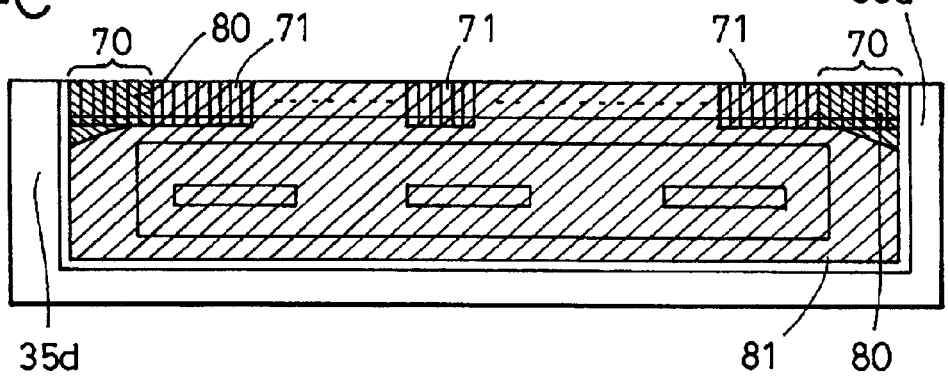

FIGS. 14A to 14C are schematic views for explaining of a process for filling a preservation liquid into the liquid ejection head chip. Note that, in FIG. 14, an area of the preservation liquid is hatched.

When a sucking means (not shown) is operated to perform suction through the ejection orifices 32*a*, a liquid 81, serving as the preservation liquid, first flows into the head chip through the liquid inlet port 36*a* as shown in FIG. 14A. The liquid 81 then fills the liquid chamber 72 as shown in FIG. 14B, and finally fills the liquid flow passages 71 as shown in FIG. 14C. The liquid 81, however, does not enter the closed flow passages 70. Accordingly, the bubble region 80 having the function of a buffer absorbing a liquid vibration is formed in each of opposite corner areas defined by the closed flow passages 70 and the liquid chamber wall 35*d*.

As another example of the manufacturing process, after filling a certain amount of the liquid 81 in the closed flow passages 70, the area occupied by the bubble region 80 may be adjusted by heating of the heaters 35*a*.

The liquid 81 is described as a preservation liquid herein. However, when users employ the liquid ejection head of this embodiment as an ink jet recording head of an ink jet recording apparatus, the preservation liquid is replaced by an ink. Of course, even in the case of the preservation liquid being replaced by an ink, the bubble regions 80 are likewise formed in the opposite corner areas defined by the closed flow passages 70 and the liquid chamber wall 35*d*.

It is to be noted that the names of materials, the temperatures, the transmittances, etc. used in the above-described manufacturing process are mentioned merely by way of example, and that those materials and numerical values should not be construed in any limiting sense.

According to the liquid ejection head of this embodiment, as described above, since the bubble region 80 having the function of a buffer absorbing a liquid vibration is formed in each of opposite corner areas defined by the closed flow passages 70, which are not communicated with the atmosphere, and the liquid chamber wall 35*d*, the occurrence of meniscus vibration in the ejection orifices 32*a* can be suppressed. As a result, ejection characteristics can be prevented from being adversely affected by an undesired phenomenon such as that small ink droplets are scattered if a next ejection signal is inputted in a condition where meniscuses are formed in shape projecting out of the ejection orifices 32*a*.

(Second Embodiment)

Figure 15:
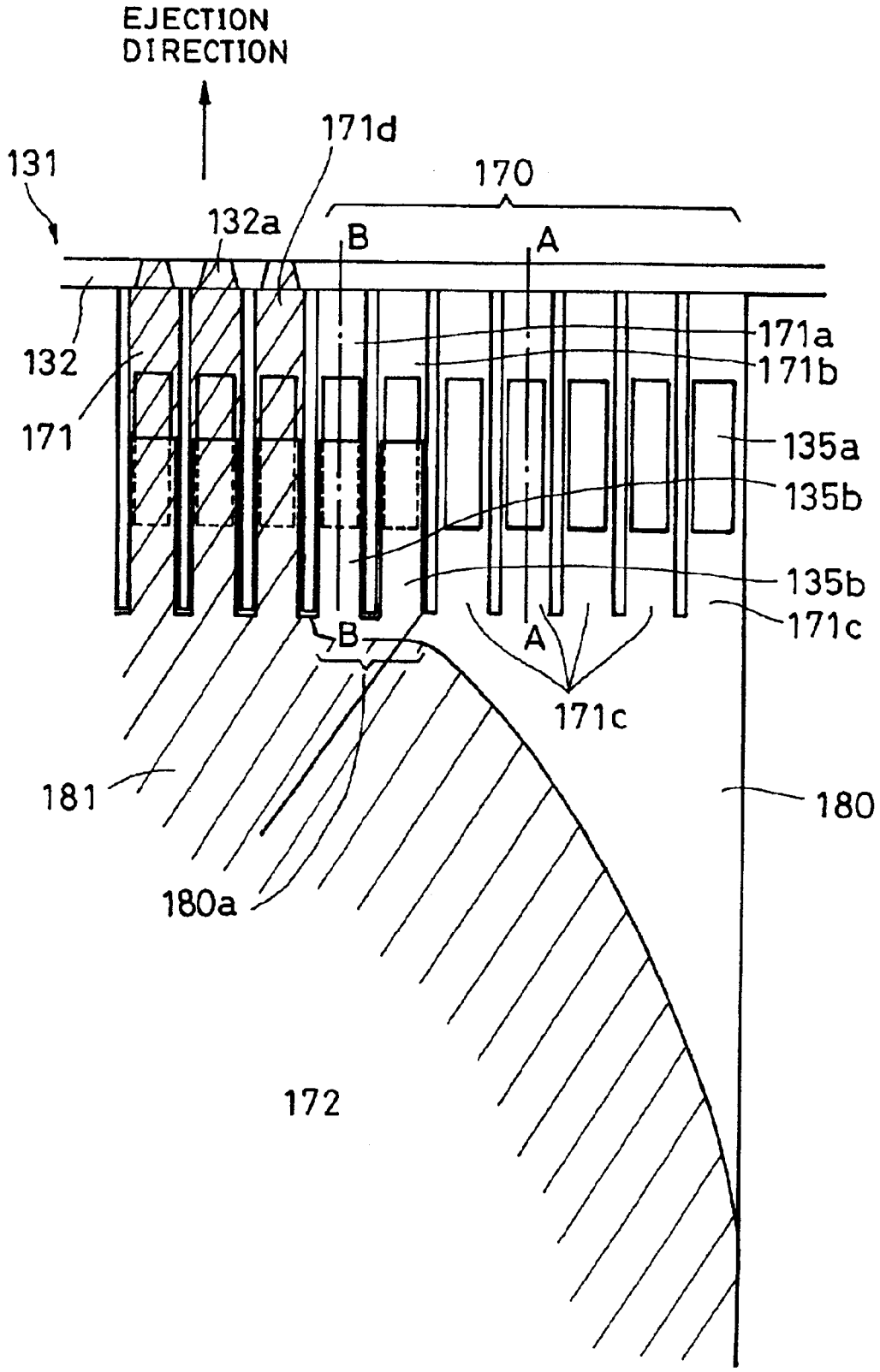
FIG. 15 is an enlarged view showing a bubble region formed behind closed flow passages of a liquid ejection head chip in a liquid ejection head unit according to a second embodiment of the present invention.

FIG. 15 shows a bubble region formed behind closed flow passages of a liquid ejection head chip in a liquid ejection head unit according to a second embodiment of the present invention. In closed flow passages 170 of a liquid ejection head chip 131 of this embodiment, movable members 135*b* are provided in two flow passages on each of opposite sides of the head chip 31, i.e., a liquid flow passage 171*a* adjacent to an outermost end one of the liquid flow passages 171, which are formed in an orifice plate 132 and contribute to ejection of the liquid through ejection orifices 132*a*, and a liquid flow passage 171*b* adjacent to the liquid flow passage 171*a*. The movable members 135*b* are not provided in liquid flow passages 171*c* of the closed flow passages 170 except for the liquid flow passages 171*a*, 171*b*. Stated otherwise, the movable members 135*b* are provided in the liquid flow passages 171*a*, 171*b*, which do not contribute to the liquid ejection.

The construction of the liquid ejection head chip 131 of this embodiment other than described above is basically the same as that of the liquid ejection head chip 31 of the first embodiment, and hence a detailed description thereof is not repeated here.

As shown in FIG. 15, when the heaters 135*b* are heated in the closed flow passages 170, in which the liquid is present, to generate and grow a bubble region 180, a part of the bubble region 180 locating in the liquid flow passages 171*a*, 171*b* is formed as a less-grown region 180*a* in which bubbles are less grown than those tending to grow extensively from the liquid flow passages 171*c* provided with no movable members 135*b* to the liquid chamber 172.

One of the reasons why the less-grown region 180*a* is formed is as follows. The presence of the movable members 135*b*, serving also as resistances against flow of the liquid in the flow passages, suppresses back waves, i.e., pressure waves, which are produced in the liquid flow passages 171*a*, 171*b* upon generation of bubbles and are moved from the side of the orifice plate 132 toward the liquid chamber 172. Then, with the arrangement that the movable members 135*b* are provided in the liquid flow passage 171*a* adjacent to an outermost end one 171*d* of the liquid flow passages 171, which are communicates with the ejection orifices 132*a* and contribute to the liquid ejection, and in the liquid flow passage 171*b* adjacent to the liquid flow passage 171*a*, the back waves are suppressed in the vicinity of the outermost-end flow passage 171*d* and the movement of the bubbles toward the rear side of the liquid flow passages is also suppressed. It is hence possible to prevent an ejection failure from occurring upon the bubbles entering the outermost-end flow passage 171*d*.

The above description has been made, by way of example, in connection with the liquid ejection head chip 131 wherein the movable members 135*b* are provided in the liquid flow passage 171*a* adjacent to the outermost-end one 171*d* of the opened liquid flow passages 171 and in the liquid flow passage 171*b* among the closed flow passages 170 formed in the head chip 131. However, the present invention is not limited to such an example, and the movable member 135*b* may be provided, e.g., in only the liquid flow passage 171*a* or in each of the liquid flow passages of all the closed flow passages 170. In other words, it is a matter of design choice to provide the movable members 135*b* in which one(s) of the liquid flow passages constituting the closed flow passages 170.

According to the liquid ejection head of this embodiment, as described above, since the bubble region 180 having the function of a buffer absorbing a liquid vibration is formed in each of opposite corner areas defined by the closed flow passages 170, which are not communicated with the atmosphere, and the liquid chamber wall 135*d*, the occurrence of meniscus vibration in the ejection orifices 132*a* can be suppressed. As with the first embodiment, therefore, ejection characteristics can be prevented from being adversely affected by an undesired phenomenon such as that small ink droplets are scattered if a next ejection signal is inputted in a condition where meniscuses are formed in shape projecting out of the ejection orifices 132*a*.

Further, according to the liquid ejection head of this embodiment, since the movable members 135*b* are provided in the liquid flow passages 171*a*, 171*b* among the closed flow passages 170, the occurrence of back waves moving toward the liquid chamber 172 is suppressed which are produced in the liquid flow passages 171*a*, 171*b* when the heaters 135*b* are heated in the closed flow passages 170, in which the liquid is present, to generate and grow the bubble region 180. The movement of bubbles to the rear side of the liquid flow passages is, therefore, also suppressed to prevent an ejection failure from occurring upon bubbles entering the outermost-end flow passage 171*d*. As a result, it is possible to make uniform characteristics of liquid ejection through all of the liquid flow passages 171 that contribute to the liquid ejection.

(Third Embodiment)

Figure 16:
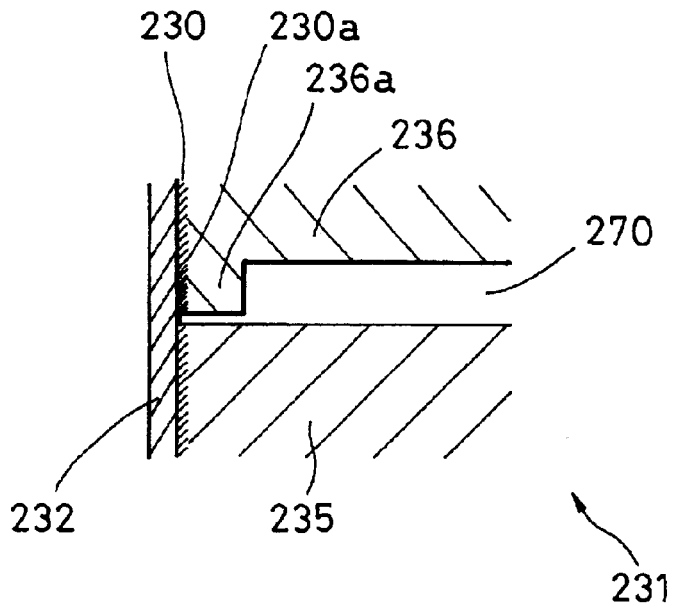
FIG. 16 is a schematic side sectional view showing a closed flow passage of a liquid ejection head chip in a liquid ejection head unit according to a third embodiment of the present invention.
Figure 17:
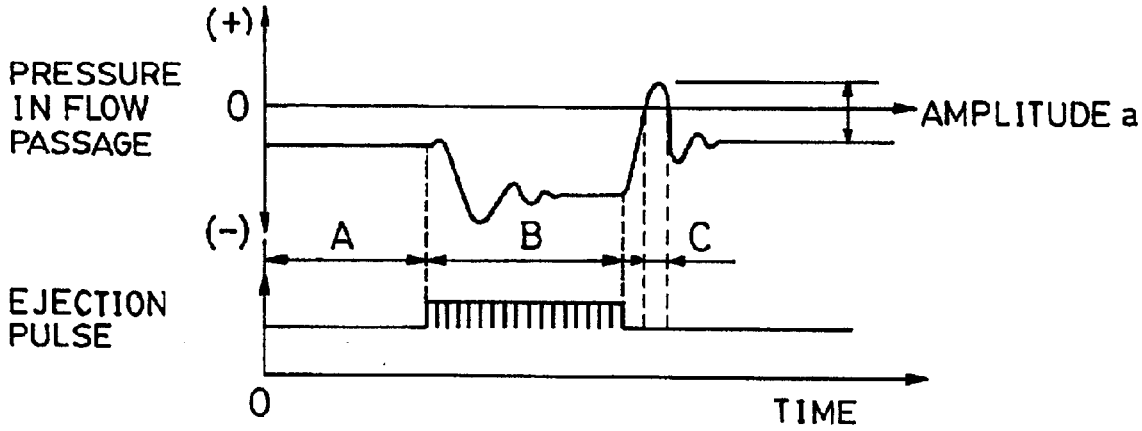
FIG. 17 is a chart showing a waveform of pressure vibration in an ink flow passage responsive to ejection pulses applied to perform one predetermined cycle of ejection in a conventional ink jet head.
Figure 18A:
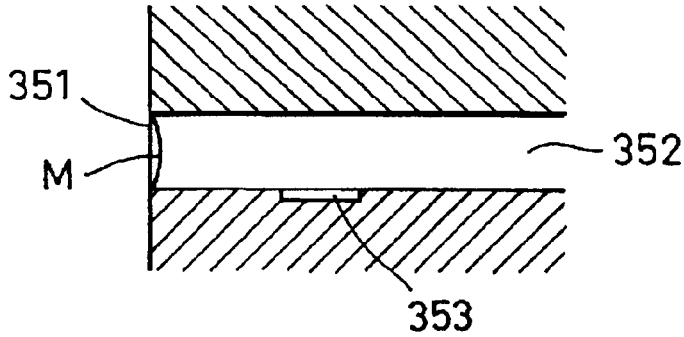
FIGS. 18A to 18C are sectional views of a nozzle showing respective meniscus states during a period A (before start of the ejection), a period B (during the ejection), and a period C (immediately after stop of the ejection) denoted in FIG. 17.
Figure 18B:
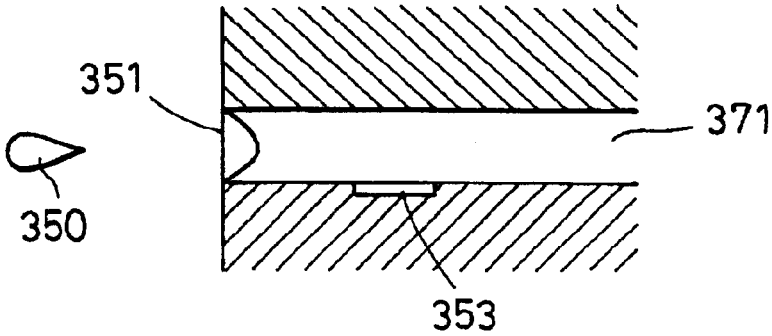
Figure 18C:
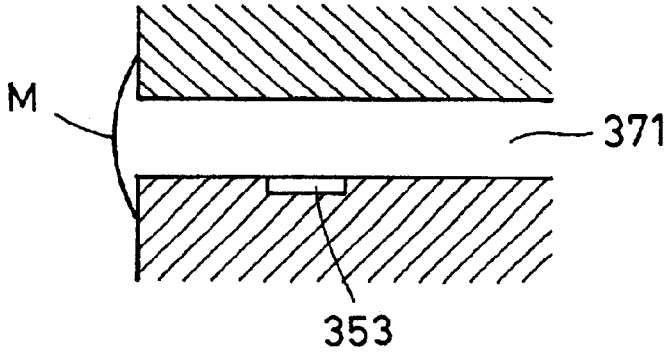

FIG. 16 is a schematic side sectional view showing a closed flow passage of a liquid ejection head chip in a liquid ejection head unit according to a third embodiment of the present invention.

In a liquid ejection head chip 231 of this embodiment, the top plate 236 has a reinforcing portion 236*a* formed in a position corresponding to a closed flow passage 270. With the provision of the reinforcing portion 236*a*, an area of the top plate 236, in which the top plate 236 is bonded to the orifice plate 232 in the form of a flat plate having no projections 32*b* described above in the first embodiment, is increased from the area of a bonding surface 230 between the orifice plate 232 and the top plate 236 in the liquid ejection head chip 231, which is given in the case of not providing the reinforcing portion 236*a*, in amount equal to a reinforcement bonding surface 230*a* as one side of the reinforcing portion 236*a* in flush with the bonding surface 230. That reinforcing arrangement enables the orifice plate 232 and the top plate 236 to be more reliably bonded with each other in a portion corresponding to the closed flow passage 270.

The reinforcing portion 236*a* shown in FIG. 16 is formed so as to leave a gap between its distal end and a heater board 235. However, the present invention is not limited to such an arrangement, and the reinforcing portion 236*a* may be formed to extend into contact with the heater board 235. In that case, the reinforcement bonding surface 230*a* is further increased. Also, in the orifice plate 232 shown in FIG. 16, the ejection orifice is not formed in the position corresponding to the closed flow passage 270 so that the closed flow passage 270 is not communicated with the atmosphere. However, when the reinforcing portion 236*a* is formed to extend into contact with the heater board 235 and to have a width equal to that of the closed flow passage 270, the reinforcing portion 236*a* can serve also to block off the communication between the interior of the closed flow passage 270 and the atmosphere. By thus blocking off the communication between the interior of the closed flow passage 270 and the atmosphere with the reinforcing portion 236*a* instead of the orifice plate 232, the flexibility in shape of the orifice plate 232 can be increased. For example, the present invention is also applicable to the orifice plate 232 modified to have ejection orifices formed in positions corresponding to the closed flow passages 270, or the orifice plate 232 modified to have a short length in the direction of array of the liquid flow passages such that it covers only the liquid flow passages which contribute to the liquid ejection, but it does not cover the closed flow passages 270.

Since the reinforcing portion 236*a* of the top plate 236 can be formed at the same time as forming the displacement restricting member (not shown in FIG. 16) which is also formed on the top plate 236 corresponding to the liquid flow passages which contribute to the liquid ejection , the number of manufacturing steps is not increased.

The construction and the manifesting method in this embodiment other than described above are basically the same as those in the first embodiment, and hence a detailed description thereof is not repeated here.

Additionally, the closed flow passage 270 in this embodiment may also have a structure having the movable member provided in the above-described second embodiment.

According to the liquid ejection head of this embodiment described above, as with the liquid ejection heads of the first and second embodiments, since a bubble region having the function of a buffer absorbing a liquid vibration is formed in each of opposite corner areas defined by the closed flow passages 170, which are not communicated with the atmosphere, and a liquid chamber wall, the occurrence of meniscus vibration in the ejection orifices 132*a* can be suppressed. Therefore, ejection characteristics can be prevented from being adversely affected by an undesired phenomenon such as that small ink droplets are scattered if a next ejection signal is inputted in a condition where meniscuses are formed in shape projecting out of the ejection orifices.

Further, according to the liquid ejection head of this embodiment, since the orifice plate 232 can be formed of a flat plate in a flexible manner, it is possible to simplify the manufacturing process of the orifice plate 232.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A liquid ejection head comprising a plurality of opened liquid flow passages arranged side by side and communicating with ejection orifices through which a liquid is ejected, thermal energy generating elements for generating thermal energy utilized to eject the liquid through said ejection orifices and generating bubbles in the liquid, and movable members arranged in an opposed relation to said thermal energy generating elements and having free ends displaceable upon generation of the bubbles, said thermal energy generating elements and said movable members being arranged respectively in said plurality of opened liquid flow passages, wherein at least one closed liquid flow passage closed at one end corresponding to the ejection orifice is provided in at least one end side of said plurality of opened liquid flow passages in a direction in which said opened liquid flow passages are arranged.

2. A liquid ejection head according to claim 1, wherein said closed liquid flow passage is provided in both end sides of said plurality of opened liquid flow passages.

3. A liquid ejection head according to claim 1, wherein said liquid ejection head includes an ejection orifice plate joined to an end surface of a head body comprising an element substrate in which said thermal energy generating elements are formed, and a top plate joined to said element substrate in an opposed relation, said ejection orifice plate having said ejection orifices formed in positions corresponding to said opened liquid flow passages.

4. A liquid ejection head according to claim 3, wherein said top plate has a reinforcing portion provided corresponding to said closed liquid flow passage and having one flat surface flush with the end surface of said head body.

5. A liquid ejection head according to claim 4, wherein said reinforcing portion has a size enough to block off communication between said closed liquid flow passage and an outside.

6. A liquid ejection head comprising a plurality of opened liquid flow passages arranged side by side and communicating with ejection orifices through which a liquid is ejected, thermal energy generating elements for generating thermal energy utilized to eject the liquid through said ejection orifices and generating bubbles in the liquid, and movable members arranged in an opposed relation to said thermal energy generating elements and having free ends displaceable upon generation of the bubbles, said thermal energy generating elements and said movable members being arranged respectively in said plurality of opened liquid flow passages, wherein a plurality of closed liquid flow passages closed at one ends corresponding to said ejection orifices are provided in at least one end side of said plurality of opened liquid flow passages in a direction in which said opened liquid flow passages are arranged, and a flow resistance is provided only in a part of said plurality of closed liquid flow passages on the side near said opened liquid flow passages.

7. A liquid ejection head according to claim 6, wherein said flow resistance is a movable member similar to said movable member.

8. A liquid ejection head according to claim 6, wherein said closed liquid flow passages are provided in both end sides of said plurality of opened liquid flow passages.

9. A liquid ejection head according to claim 6, wherein said liquid ejection head includes an ejection orifice plate joined to an end surface of a head body comprising an element substrate in which said thermal energy generating elements are formed, and a top plate joined to said element substrate in an opposed relation, said ejection orifice plate having said ejection orifices formed in positions corresponding to said opened liquid flow passages.

10. A liquid ejection head according to claim 9, wherein said top plate has a reinforcing portion provided corresponding to each of said closed liquid flow passages and having one flat surface flush with the end surface of said head body.

11. A liquid ejection head according to claim 10, wherein said reinforcing portion has a size enough to block off communication between said closed liquid flow passage and an outside.

12. A liquid ejection head comprising a plurality of opened liquid flow passages arranged side by side and communicating with ejection orifices through which a liquid is ejected, and thermal energy generating elements for generating thermal energy utilized to eject the liquid through said ejection orifices and generating bubbles in the liquid, said thermal energy generating elements being arranged respectively in said plurality of opened liquid flow passages, wherein a plurality of closed liquid flow passages closed at one ends corresponding to said ejection orifices are provided in at least one end side of said plurality of opened liquid flow passages in a direction in which said opened liquid flow passages are arranged, and a flow resistance is provided only in a part of said plurality of closed liquid flow passages on the side near said opened liquid flow passages.

13. A liquid ejection head according to claim 12, wherein said closed liquid flow passages are provided in both end sides of said plurality of opened liquid flow passages.

14. A liquid ejection head according to claim 12, wherein said liquid ejection head includes an ejection orifice plate joined to an end surface of a head body comprising an element substrate in which said thermal energy generating elements are formed, and a top plate joined to said element substrate in an opposed relation, said ejection orifice plate having said ejection orifices formed in positions corresponding to said opened liquid flow passages.

15. A liquid ejection head according to claim 14, wherein said top plate has a reinforcing portion provided corresponding to each of said closed liquid flow passages and having one flat surface flush with the end surface of said head body.

16. A liquid ejection head according to claim 15, wherein said reinforcing portion has a size enough to block off communication between said closed liquid flow passage and an outside.

17. A method of manufacturing a liquid ejection head comprising the steps of:

preparing a body of said liquid ejection head, which comprises a plurality of liquid flow passages arranged side by side and communicating with holes at one ends thereof, and thermal energy generating elements for generating thermal energy utilized to eject a liquid through ejection orifices communicating with said holes and generating bubbles in the liquid, said thermal energy generating elements being arranged respectively in said plurality of liquid flow passages; and joining the body of said liquid ejection head and an ejection orifice plate having said ejection orifices formed therein in number less than the number of said holes to each other such that communication is maintained between a part of said holes and said ejection orifices, whereby said plurality of flow passage are divided into opened liquid flow passages communicating with said ejection orifices and closed liquid flow passages which are closed by said ejection orifice plate at one ends corresponding to said ejection orifices and are provided in at least one end side of said plurality of opened liquid flow passages in a direction in which said opened liquid flow passages are arranged.

18. A method of manufacturing a liquid ejection head according to claim 17, further comprising the step of forming at least one of said closed liquid flow passages, in which a flow resistance giving resistance against the liquid flowing in the closed liquid flow passage is provided, between said opened liquid flow passages and the closed liquid flow passages other than said at least one closed liquid flow passage in which said flow resistance is provided.

19. A method of manufacturing a liquid ejection head according to claim 18, further comprising the step of forming, as said flow resistance, a movable members arranged in a bubble generating area of said closed liquid flow passage, in which bubbles are generated in the liquid, and having free ends displaceable upon growth of the bubbles.

20. A method of manufacturing a liquid ejection head according to claim 19, further comprising the step of preparing said head body by joining a top plate in an opposed relation to an element substrate in which said thermal energy generating elements are formed, and forming a reinforcing portion on said top plate in a position corresponding to each of said closed liquid flow passages, said reinforcing portion having one flat surface flush with an end surface of said head body.

21. A method of manufacturing a liquid ejection head according to claim 20, further comprising the step of forming said reinforcing portion in size enough to block off communication between said closed liquid flow passage and an outside.

22. A method of manufacturing a liquid ejection head according to claim 19, further comprising the step of filling a liquid into said opened liquid flow passages through suction from the end surface side of said head body.

23. A method of manufacturing a liquid ejection head according to claim 22, further comprising the step of, after said filling step, applying energy to said energy generating elements in at least said closed liquid flow passages.

24. A method of manufacturing a liquid ejection head according to claim 17, further comprising the step of forming said closed liquid flow passages in both end sides of said opened liquid flow passages.

* * * * *